US009033069B2

(12) United States Patent
Zhang

(10) Patent No.: US 9,033,069 B2
(45) Date of Patent: May 19, 2015

(54) HIGH-SHEAR ROLLER CONE AND PDC HYBRID BIT

(75) Inventor: Zhehua Zhang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 510 days.

(21) Appl. No.: 12/985,054

(22) Filed: Jan. 5, 2011

(65) Prior Publication Data

US 2011/0162893 A1 Jul. 7, 2011

Related U.S. Application Data

(60) Provisional application No. 61/292,276, filed on Jan. 5, 2010, provisional application No. 61/330,634, filed on May 3, 2010.

(51) Int. Cl.

| | |
|---|---|
| ***E21B 10/08*** | (2006.01) |
| ***E21B 10/22*** | (2006.01) |
| ***E21B 10/14*** | (2006.01) |
| ***E21B 10/20*** | (2006.01) |
| ***E21B 10/42*** | (2006.01) |

(52) U.S. Cl.

CPC ..... *E21B 10/14* (2013.01); *E21B 10/08* (2013.01); *E21B 10/20* (2013.01); *E21B 10/42* (2013.01)

(58) Field of Classification Search

CPC ..... E21B 10/003; E21B 10/08; E21B 10/20; E21B 10/22; E21B 10/24; E21B 10/083

USPC ..... 175/336

See application file for complete search history.

(56) References Cited

U.S. PATENT DOCUMENTS

| | | | |
|---|---|---|---|
| 334,594 | A | 1/1886 | Maloy |
| 1,026,886 | A | 5/1912 | Thomas |
| 1,124,243 | A | 1/1915 | Hughes |
| 1,131,701 | A | 3/1915 | Hughes |
| 1,143,274 | A | 6/1915 | Hughes |
| 1,195,208 | A | 8/1916 | Griffin |
| 1,327,913 | A | 1/1920 | Hughes |
| 1,348,419 | A | 8/1920 | Hughes |
| 1,374,867 | A | 4/1921 | Wadsworth |
| 1,402,684 | A | 1/1922 | Thomas |
| 1,747,908 | A | 2/1930 | Seifert |
| 1,812,475 | A | 6/1931 | Gildersleeve et al. |

(Continued)

FOREIGN PATENT DOCUMENTS

WO 2008124572 A1 10/2008

OTHER PUBLICATIONS

International Search Report and Written Opinion issued in related PCT Application No. PCT/US2011/020091; Dated Jun. 23, 2011 (8 pages).

(Continued)

*Primary Examiner* — Brad Harcourt
(74) *Attorney, Agent, or Firm* — Osha Liang LLP

(57) ABSTRACT

A drill bit having a bit body, at least one blade extending radially from the bit body, a plurality of blade cutting elements disposed on each blade, at least one journal extending downwardly and radially outward from a longitudinal axis of the drill bit, a roller cone or roller disc mounted rotatably to each journal, and a plurality of cutting elements disposed on each roller cone or roller disc, and methods for making the drill bit are disclosed.

23 Claims, 22 Drawing Sheets

(56) References Cited

U.S. PATENT DOCUMENTS

| | | | | |
|---|---|---|---|---|
| 1,850,358 | A | 3/1932 | Scott | |
| 2,174,587 | A | 10/1939 | Love | |
| 2,634,955 | A | 4/1953 | Johnson | |
| 2,742,439 | A | 4/1956 | Hallett | |
| 3,743,037 | A | 7/1973 | Bulakh et al. | |
| 3,945,447 | A | 3/1976 | Peterson | |
| 4,444,281 | A * | 4/1984 | Schumacher et al. | 175/336 |
| 4,446,935 | A | 5/1984 | Schumacher, Jr. | |
| 4,641,976 | A * | 2/1987 | Kar | 384/95 |
| 4,819,517 | A | 4/1989 | Vezirian | |
| 4,832,143 | A | 5/1989 | Kaalstad et al. | |
| 4,874,047 | A | 10/1989 | Hixon | |
| 5,064,007 | A | 11/1991 | Kaalstad | |
| 5,147,000 | A | 9/1992 | Kaalstad | |
| 5,598,895 | A | 2/1997 | Anderson et al. | |
| 5,695,019 | A | 12/1997 | Shamburger, Jr. | |
| 5,975,223 | A | 11/1999 | Karlsson | |
| 6,173,797 | B1 * | 1/2001 | Dykstra et al. | 175/374 |
| 6,439,326 | B1 * | 8/2002 | Huang et al. | 175/334 |
| 6,450,271 | B1 | 9/2002 | Tibbitts et al. | |
| 6,561,292 | B1 | 5/2003 | Portwood | |
| 7,195,085 | B2 | 3/2007 | Pia | |
| 7,464,773 | B2 | 12/2008 | Rives | |
| 7,819,208 | B2 * | 10/2010 | Pessier et al. | 175/336 |
| 2001/0054514 | A1 | 12/2001 | Sullivan et al. | |
| 2002/0000336 | A1 | 1/2002 | Claesson et al. | |
| 2002/0029909 | A1 | 3/2002 | Griffo et al. | |
| 2007/0062736 | A1 | 3/2007 | Cariveau et al. | |
| 2008/0011519 | A1 | 1/2008 | Smith et al. | |
| 2009/0057030 | A1 | 3/2009 | Didericksen et al. | |
| 2009/0126998 | A1 * | 5/2009 | Zahradnik et al. | 175/57 |
| 2009/0272582 | A1 | 11/2009 | McCormick et al. | |
| 2009/0283333 | A1 | 11/2009 | Lockwood et al. | |
| 2010/0155145 | A1 * | 6/2010 | Pessier et al. | 175/336 |
| 2010/0163313 | A1 | 7/2010 | Lin et al. | |
| 2010/0224417 | A1 | 9/2010 | Zahradnik et al. | |
| 2011/0162893 | A1 | 7/2011 | Zhang | |
| 2012/0031671 | A1 | 2/2012 | Propes | |
| 2012/0031673 | A1 | 2/2012 | MacKenzie | |

OTHER PUBLICATIONS

Notification Concerning Transmittal of International Preliminary Report on Patentability issued in corresponding International Patent Application PCT/US2010/043604; Dated Feb. 9, 2012 (5 pages).

Notification Concerning Transmittal of International Preliminary Report on Patentability issued in corresponding International Patent Application PCT/US2012/043803; Dated Feb. 9, 2012 (5 pages).

US Office Action issued for U.S. Appl. No. 12/844,589 mailed Jan. 4, 2013 (25 pages).

* cited by examiner

HIGH-SHEAR ROLLER CONE AND PDC HYBRID BIT

CROSS-REFERENCE TO RELATED APPLICATIONS

Pursuant to 35 U.S.C. §119(e), this Application claims priority to U.S. Provisional Application 61/292,276, filed on Jan. 5, 2010, and U.S. Provisional Application 61/330,634, filed on May 3, 2010, which are herein incorporated by reference in their entirety.

BACKGROUND OF INVENTION

1. Field of the Invention

Embodiments disclosed herein relate generally to drill bits. In particular, embodiments disclosed herein relate to hybrid drill bits having roller cones or disks and fixed blades.

2. Background Art

Historically, there have been two main types of drill bits used for drilling earth formations, drag bits and roller cone bits. The term "drag bits" refers to those rotary drill bits with no moving elements. Drag bits include those having cutting elements attached to the bit body, which predominantly cut the formation by a shearing action. Roller cone bits include one or more roller cones rotatably mounted to the bit body. These roller cones have a plurality of cutting elements attached thereto that crush, gouge, and scrape rock at the bottom of a hole being drilled.

Typically, bit type may be selected based on the primary nature of the formation to be drilled. However, many formations have mixed characteristics (i.e., the formation may include both hard and soft zones), which may reduce the rate of penetration of a bit (or, alternatively, reduces the life of a selected bit) because the selected bit is not preferred for certain zones. For example, both milled tooth roller cone bits and PDC bits can efficiently drill soft formations, but PDC bits will typically have a rate of penetration several times higher than roller cone bits.

PDC Drill Bits

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

An example of a prior art PDC bit having a plurality of cutters with ultra hard working surfaces is shown in FIG. 1. The drill bit 10 includes a bit body 11 having a threaded upper pin end 12 and a cutter face 13. The cutter face 13 typically includes a plurality of ribs or blades 14 arranged about the rotational axis of the drill bit and extending radially outward from the bit body 11. Cutting elements, or cutters, 15 are embedded in the blades 14 at predetermined angular orientations and radial locations relative to a working surface and with a desired back rake angle and side rake angle against a formation to be drilled.

A plurality of orifices 16 are positioned on the bit body 11 in the areas between the blades 14, which may be referred to as "gaps" or "fluid courses." The orifices 16 are commonly adapted to accept nozzles. The orifices 16 allow drilling fluid to be discharged through the bit in selected directions and at selected rates of flow between the blades 14 for lubricating and cooling the drill bit 10, the blades 14 and the cutters 15. The drilling fluid also cleans and removes the cuttings as the drill bit 10 rotates and penetrates the geological formation. Without proper flow characteristics, insufficient cooling of the cutters 15 may result in cutter failure during drilling operations. The fluid courses are positioned to provide additional flow channels for drilling fluid and to provide a passage for formation cuttings to travel past the drill bit 10 toward the surface of a wellbore (not shown).

Roller Cone Drill Bits

Roller cone drill bits are generally used to drill formations that fail by crushing and gouging as opposed to shearing. Typically, roller cone drill bits are also preferred for heterogeneous formations that initiate vibration in drag bits. Roller cone drill bits include milled tooth bits and insert bits. Milled tooth roller cone bits may be used to dill relatively soft formations, while insert roller cone bits are suitable for medium or hard formations.

Roller cone drill bits typically include a bit body with a threaded pin formed on the upper end of the bit body for connecting to a drill string, and one or more legs extending from the lower end of the bit body. Referring now to FIGS. 2 and 3, a conventional insert roller cone drill bit, generally designated as 20, consists of bit body 21 forming an upper pin end 22 and a cutter end 23 of roller cones 24 that are supported by legs 25 extending from body 21. The threaded pin end 22 is adapted for assembly onto a drill string (not shown) for drilling oil wells or the like. Each of the legs 25 terminate in a shirttail portion 26.

Each of the roller cones 24 typically have a plurality of cutting elements 27 thereon for cutting earth formation as the drill bit 20 is rotated about the longitudinal axis L. FIGS. 2 and 3 show cutting elements 27 pressed within holes formed in the surfaces of the cones 24; however, milled tooth bits have hardfaced steel teeth milled on the outside of the cone 24 instead of carbide inserts. Nozzles 28 in the bit body 21 introduce drilling mud into the space around the roller cones 24 for cooling and carrying away formation chips drilled by the drill bit 20. Drilling fluid is directed within the hollow pin end 22 of the bit 20 to an interior plenum chamber 29 formed by the bit body 21. The fluid is then directed out of the bit through the one or more nozzles 28.

Each leg 25 includes a journal 30 extending downwardly and radially inward towards a center line, or longitudinal axis, L of the bit body 21. A bearing assembly 31 (e.g., roller bearing, ball bearing, etc.) is disposed between the cone 24 and the journal 30. Roller cones 24 are retained on journal 30 by a plurality of balls 32, which are fitted into complementary ball races 33*a*, 33*b* in the cone 24 and on the journal 30, respectively, forming a ball race. These balls 32 are inserted through a ball passage 34, which extends through the journal 30 between the ball races 33*a*, 33*b* and the exterior of the drill bit 20. A cone 24 is first fitted on the journal 30, and then the balls 32 are inserted through the ball passage 34. The balls 32 carry any thrust loads tending to remove the cone 24 from the journal 30 and thereby retain the cone 24 on the journal 30. The balls 32 are retained in the races by a ball retainer 35 inserted through the ball passage 34 after the balls are in place and welded therein.

Contained within bit body 21 is a grease reservoir system, generally designated as 36. Lubricant passage 37 is provided from a reservoir chamber 38 to ball race surfaces 33*a*, 33*b* formed between a cone 24 and a journal 30. The ball bearing surfaces 33*a*, 33*b* between the cone 24 and journal 30 are lubricated by a lubricant or grease composition. Lubricant or grease is retained in the bearing structure by a resilient seal 39 between the cone 24 and journal 30.

Hybrid Drill Bits

Both roller cone and PDC bits have their own advantages. Due to the difference in cutting mechanisms and cutting element materials, they are best suited for different drilling conditions. Roller cone bits predominantly use a crushing mechanism in drilling, which gives roller cone bits overall durability and strong cutting ability (particularly when compared to previous bit designs, including disc bits). PDC bits use a shearing mechanism for cutting, which allows higher performance in soft formation drilling than roller cone bits are able to achieve.

Thus, in drilling operations facing mixed formations, using one type of drill bit over the other may not necessarily be adequate for the entire operation. Hybrid drill bits that use a combination of one or more rolling cutters and one or more fixed blades have been proposed in the prior art. However, problems arise during the design of these hybrid bits in trying to combine rolling cutters and fixed blades within a limited amount of space.

Accordingly, there exists a continuing need for developments in drill bits that may provide advantages of both roller cone drill bits and fixed cutter drill bits.

SUMMARY OF INVENTION

In one aspect, embodiments disclosed herein relate to a drill bit having a bit body, at least one blade extending radially from the bit body, a plurality of blade cutting elements disposed on the at least one blade, at least one journal extending downwardly and radially outward from a longitudinal axis of the drill bit, wherein the journal is integral with the bit body, a rolling cutter mounted rotatably to each of the at least one journal, wherein the rolling cutter is a roller cone or a roller disk, and a plurality of cutting elements disposed on each rolling cutter In another aspect, embodiments disclosed herein relate to a drill bit having a bit body, at least one blade extending radially from the bit body, a plurality of blade cutting elements disposed on the at least one blade, at least one journal extending downwardly and radially outward from a longitudinal axis of the drill bit, a rolling cutter mounted rotatably to each of the at least one journal, wherein the rolling cutter is a roller cone or a roller disk, a ball race configured between the at least one journal and the rolling cutter, a plurality of retention balls disposed within the ball race, a ball passage extending from the ball race into the bit body, a ball retainer, and a plurality of cutting elements disposed on each rolling cutter.

In another aspect, embodiments disclosed herein relate to a drill bit having a bit body, wherein the bit body has at least one blade extending radially from the bit body and at least one journal, and the bit body is made of at least 75% matrix material.

In another aspect, embodiments disclosed herein relate to a method of manufacturing a hybrid drill bit that includes forming a bit body comprising a threaded pin end and a cutting end, machining the cutting end of the bit body to form at least one journal extending downward and radially outward from a longitudinal axis of the bit body, and attaching at least one blade onto the cutting end of the bit body.

In yet another aspect, embodiments disclosed herein relate to a method of manufacturing a hybrid drill bit that includes forming a bit body comprising a threaded pin end and a cutting end, wherein at least one blade is formed on the cutting end, and attaching at least one journal to the cutting end of the bit body such that the at least one journal extends downward and radially outward from a longitudinal axis of the bit body.

Other aspects and advantages of the invention will be apparent from the following description and the appended claims.

DETAILED DESCRIPTION

In one aspect, embodiments disclosed herein relate to hybrid drill bits having both fixed blades and rolling cutters. As used herein, the term "rolling cutters" may refer to either roller cones or roller disks. In more particular aspects, embodiments disclosed herein relate to hybrid drill bits having both fixed blades and outwardly facing roller cones (or disks). Outwardly facing refers to rolling cutters attached to a drill bit where the noses of the cones are angled radially outward away from the longitudinal axis, or centerline, of the bit. Use of such cone configuration may allow for a bit having a cutting action unique for PDC bits and roller cone bits, as well as greater cutting efficiency by contributing some gouging, as well as some shearing, action that is coupled with the shearing action of the cutting elements on the fixed blades. Further, rolling cutters that are assembled outwardly provide more shearing action than conventional roller cone bits with inwardly assembled rolling cutters. Thus, outwardly facing roller cones may also be referred to as high shear roller cones. The outwardly directed roller cones may be arranged in an alternating configuration with the blades.

Figure 1:
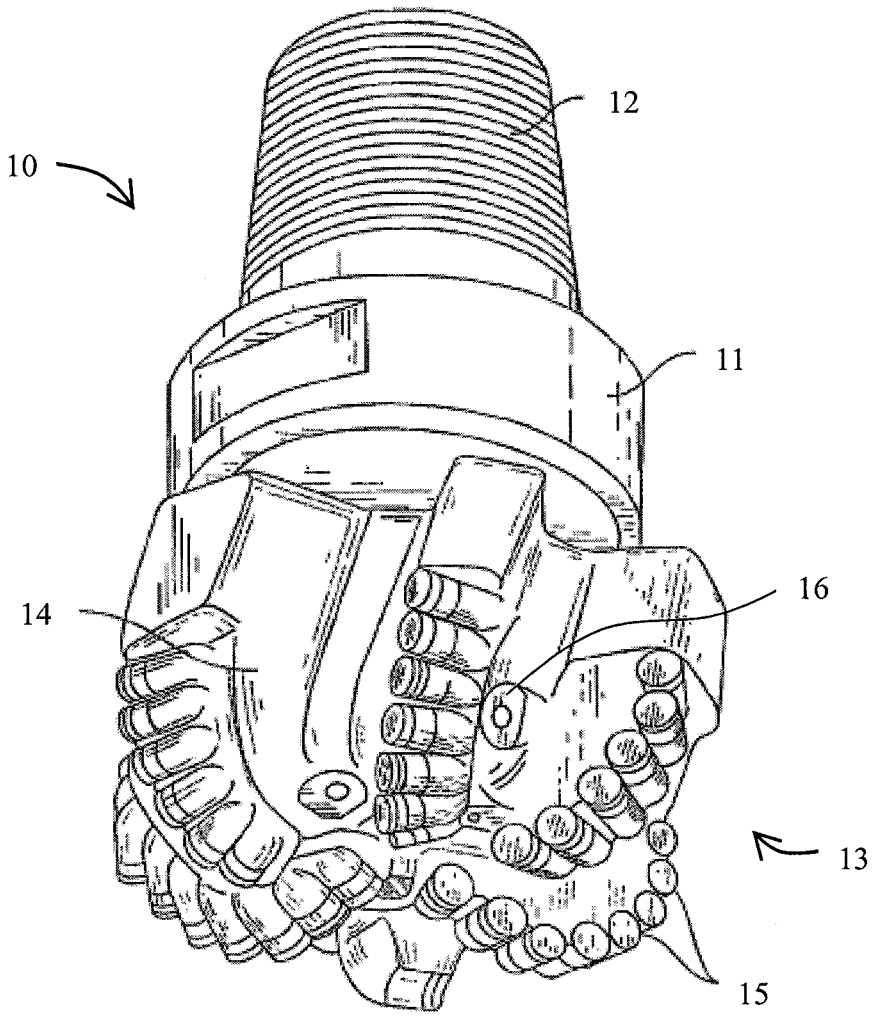
FIG. 1 (Prior Art)
FIG. 1 is a perspective of a conventional PDC drill bit.
Figure 2:
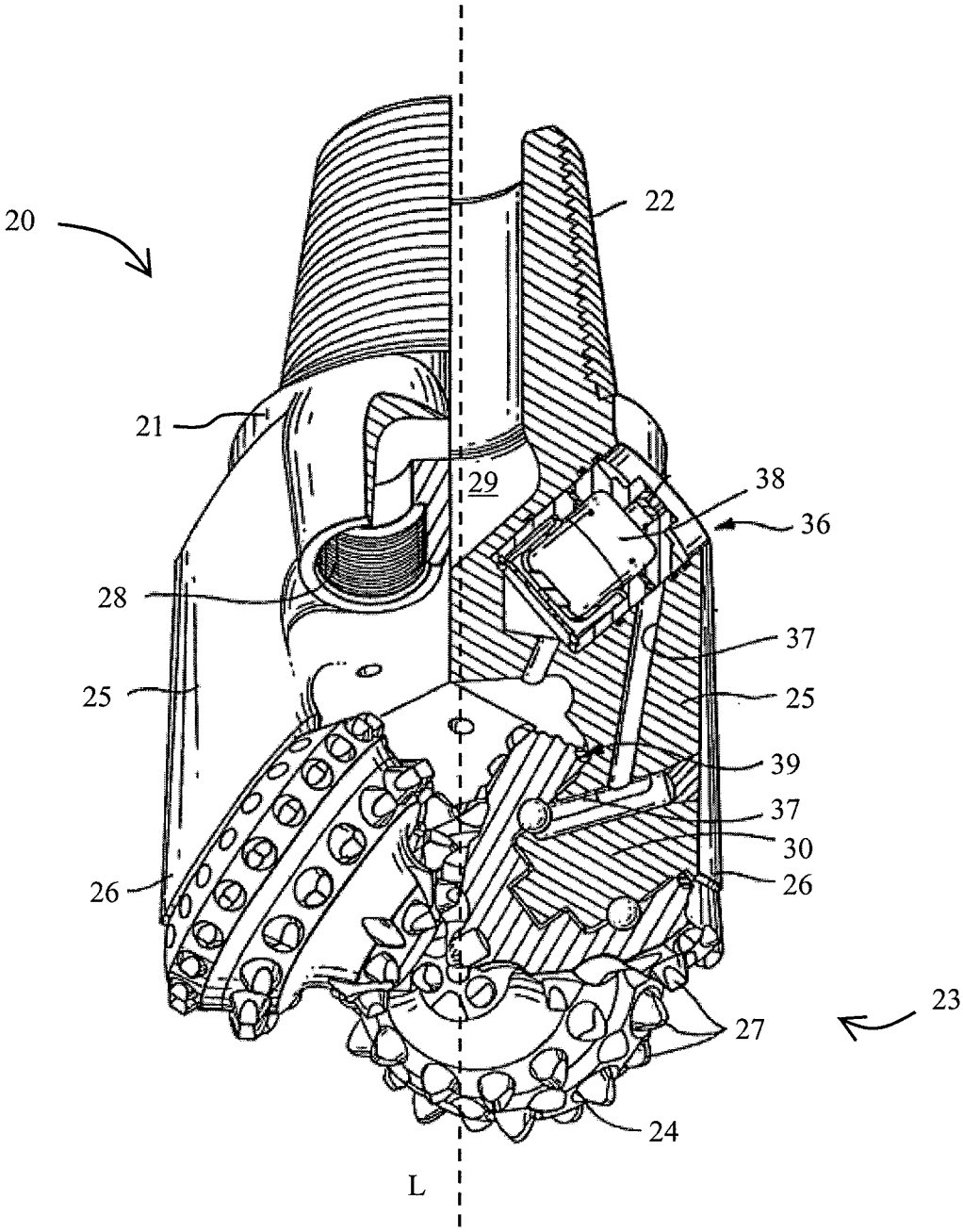
FIG. 2 (Prior Art)
FIG. 2 is a semi-schematic perspective of a conventional three cone roller cone drill bit.
Figure 3:
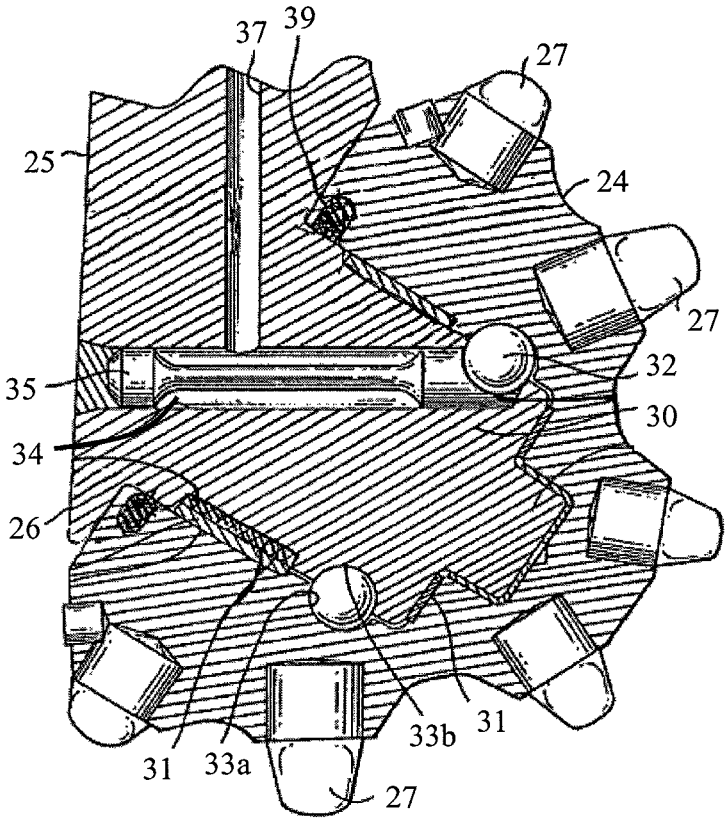
FIG. 3 (Prior Art)
FIG. 3 is a partial cross-section of the drill bit in FIG. 2.
Figure 4A:
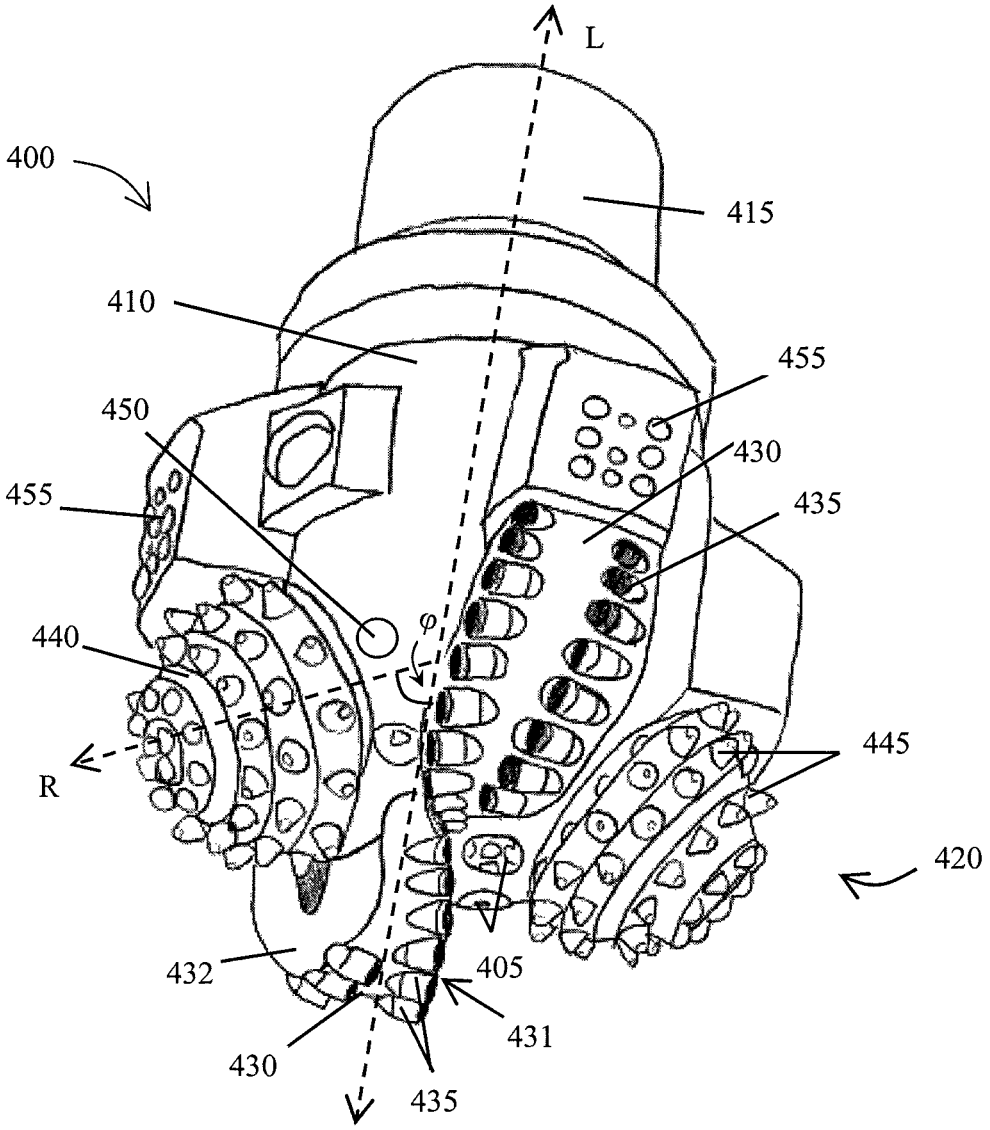
FIG. 4A-B shows a side and bottom view of a hybrid bit according to one embodiment of the present disclosure.
Figure 4B:
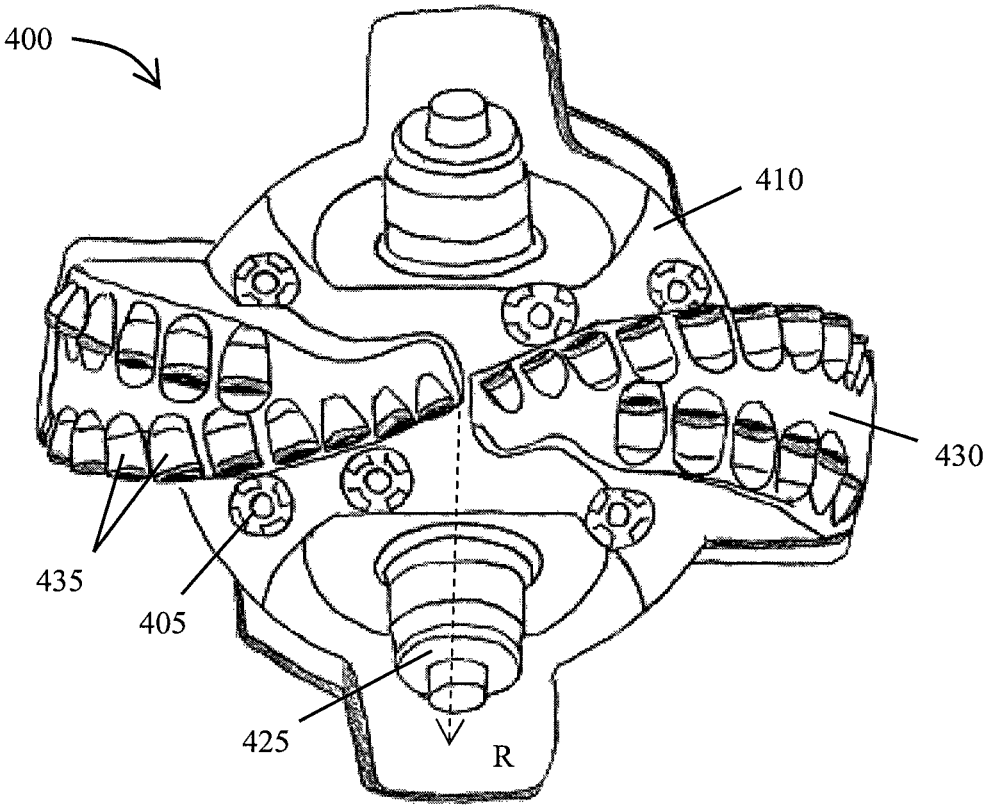

Referring to FIGS. 4A and 4B, two views of a hybrid drill bit according to one embodiment of the present disclosure are shown. As shown in FIG. 4A, a hybrid drill bit 400 includes a bit body 410 having at its upper end, a threaded pin end 415 for coupling the bit 400 to a drill string (not shown), and at its lower end, a cutting end 420. The cutting end 420 has a plurality of blades 430 and a plurality of journals 425 (shown in FIG. 4B) extending downward and radially outward, away from the longitudinal axis L of bit 400. On each journal 425, a roller cone 440 having a frustoconical shape is rotatably mounted. Each blade 430 has a leading edge 431 and a trailing edge 432, wherein the leading edge faces the direction in which the bit is rotating. A plurality of blade cutting elements 435 is disposed on each blade 430, and a plurality of roller cone cutting elements 445 is disposed on each roller cone 440. Each blade cutting element 435 has a portion which typically is brazed in a recess or pocket formed in the blade 430 on the exterior face of the bit body. The blade cutting elements 435 are positioned along the leading edges of the blades 430 so that as the bit body 410 is rotated, the blade cutting elements 435 engage and drill the earth formation. Further, as the bit rotates, roller cones 440 also rotate and roller cone cutting elements 445 also engage and drill the earth formation. The bit 400 also includes gage pads 455, the outer surface of which is at the diameter of the bit and establishes the bit's size. Advantageously, the gage pads 455 may be positioned above the roller cones 440 to stabilize the bit and protect gage inserts.

Various types of roller cone cutting elements 445 may be used. Examples of roller cone cutting elements 445 may include tungsten carbide inserts, diamond enhanced inserts, milled teeth, and polycrystalline cubic boron nitride (PCBN) cutting elements. Likewise, various types of blade cutting elements 435 may be used. Examples of blade cutting elements 435 may include cutters having a substrate with an ultrahard layer disposed thereon, which may include polycrystalline diamond (PCD), PCBN, and thermally stable polycrystalline diamond (TSP).

A plurality of orifices 405 are positioned on the bit body 410 in the areas between the blades 430 and roller cones 440. Orifices 405 allow drilling fluid to be discharged through the bit 400 in selected directions and at selected rates of flow between the cutting blades 430 and roller cones 440 for lubricating and cooling the blades 430, the roller cones 440, and the cutting elements 435, 445. The drilling fluid also cleans and removes the cuttings as the drill bit 400 rotates and penetrates the geological formation. The amount of orifices 405 on the bit body 410 may be limited by the number of blades and roller cones on the bit. For example, fewer orifices 405 may fit on a bit body 410 having three blades 430 and three roller cones 440 than on a bit body 410 having two blades 430 and two roller cones 440.

Figure 9A:
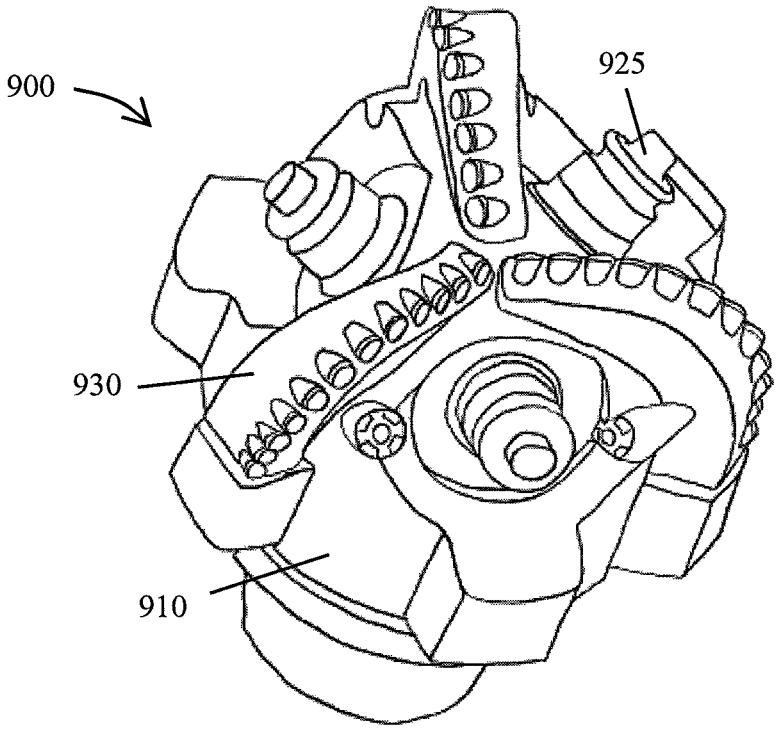
FIG. 9A-9B shows a bottom and side view of a hybrid bit according to another embodiment of the present disclosure.
Figure 9B:
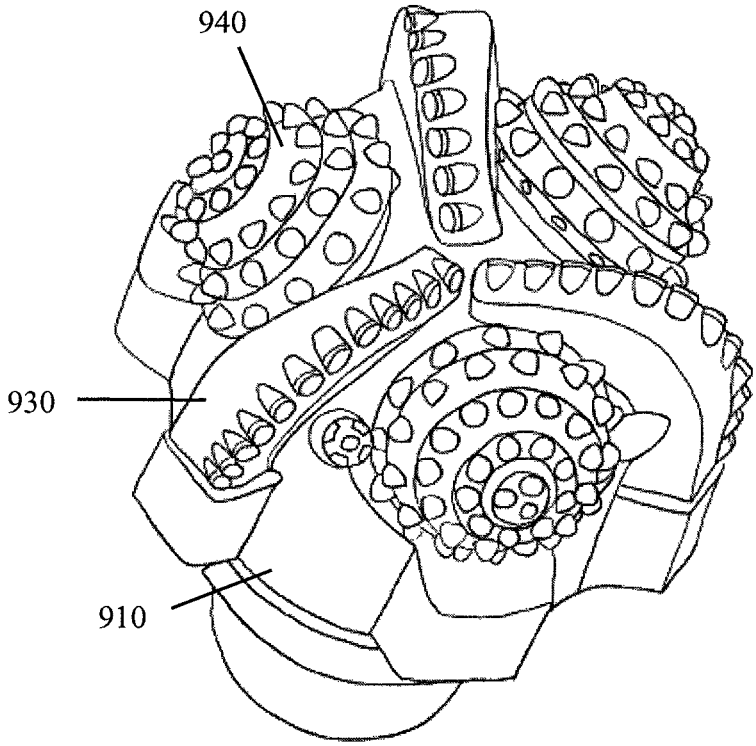
Figure 10:
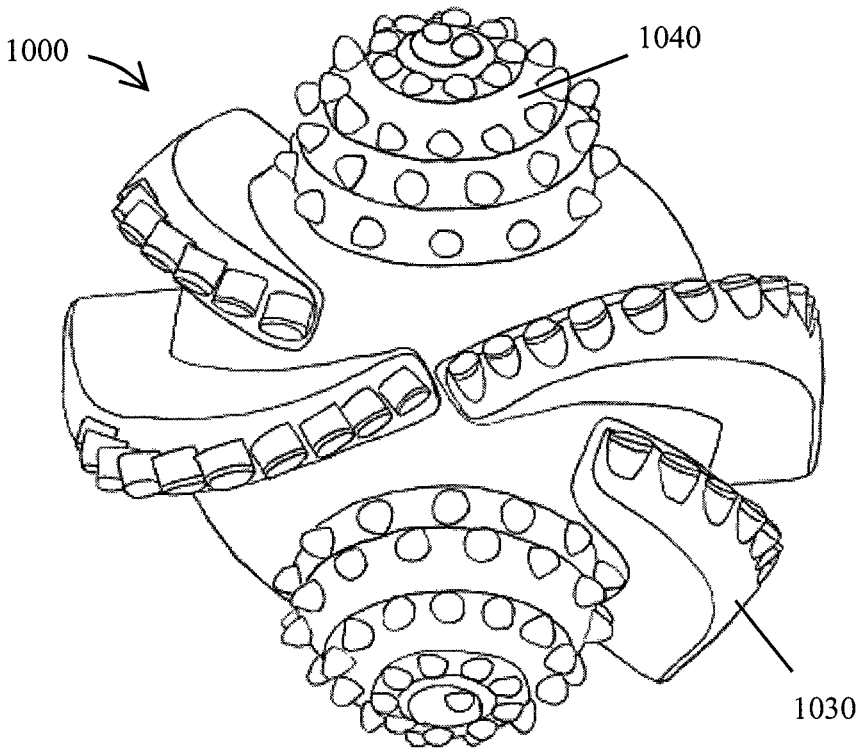
FIG. 10 shows a bottom view of a hybrid bit according to another embodiment of the present disclosure.

As shown in FIGS. 4A and 4B, two blades 430 and two roller cones 440 are positioned in an alternating arrangement about the center of the bit body 410. However, the present disclosure is not limited to a bit having two blades and two roller cones in an alternating arrangement. For example, as shown in FIGS. 9A and 9B, a hybrid bit 900 has three journals 925, wherein an outwardly facing roller cone 940 is fitted to each journal 925, and three blades 930, wherein the blades 930 and the roller cones 940 are in an alternating arrangement around the bit body 910. In other embodiments, as shown in FIG. 10, a hybrid bit 1000 has two roller cones 1040 positioned between four blades 1030, wherein two blades 1030 are on either side of each roller cone 1040. It may be advantageous to have more blades than roller cones on a hybrid bit to increase the useful life of the tool for some drilling applications. In particular, providing more blades than roller cones may relieve potential increased wear on roller cone cutting elements of outward-facing roller cones. However, the particular combination of blades and roller cones may depend on the type of formation to be drilled and the relative amount of each cutting action desired for the particular formation. For example, a hybrid bit having two cones and one blade may be useful for soft formations, and a hybrid bit having two cones and two blades may be useful for medium formations. Thus, any combination of roller cone(s) and blade(s) exists, so long as there is at least one blade and at least one roller cone to create the hybrid bit.

Additionally, blades and roller cones may be positioned in a non-symmetrical arrangement. Examples of non-symmetrical arrangements according to the present disclosure may include, but are not limited to, hybrid bits having two or more blades and one outwardly-facing roller cone, hybrid bits having three blades and two outwardly-facing roller cones, hybrid bits having two or more outwardly-facing roller cones and one blade. In some embodiments, a non-symmetrical arrangement of blades and roller cones may be used to create a walking (i.e., directional) drill bit.

The bit body of a hybrid drill bit according to various embodiments of the present disclosure may be formed in a mold from steel. Specifically, a bit body may be formed of steel having 0.15-0.35% carbon by weight, and from 0.15-0.2% carbon by weight (typical of roller cone bits) or 0.25-0.35% carbon by weight (typical of fixed cutter bits) in particular embodiments. Bit bodies formed from steel may have journals integral with the bit body (i.e., formed together in a mold), which are machined into the desired shape and position on the bit body, and blades separately attached to the bit body. Alternatively, a bit body formed of steel may have blades integral with the bit body and journals separately attached thereto. Further, blades and journals may both be integral with a steel bit body, or, blades and journals may both be separately attached to the steel bit body. Use of separately attached blades and/or journals may be desired due to different material requirements for each component, based on their structure, function, manufacturing details, expected loads, etc. For example, a bit body and blades may be formed together from E4130 steel in a mold, the bit body including a nozzle bore, a reservoir for lubricant or grease, cutter pockets, and journal assembly holes.

Figure 11:
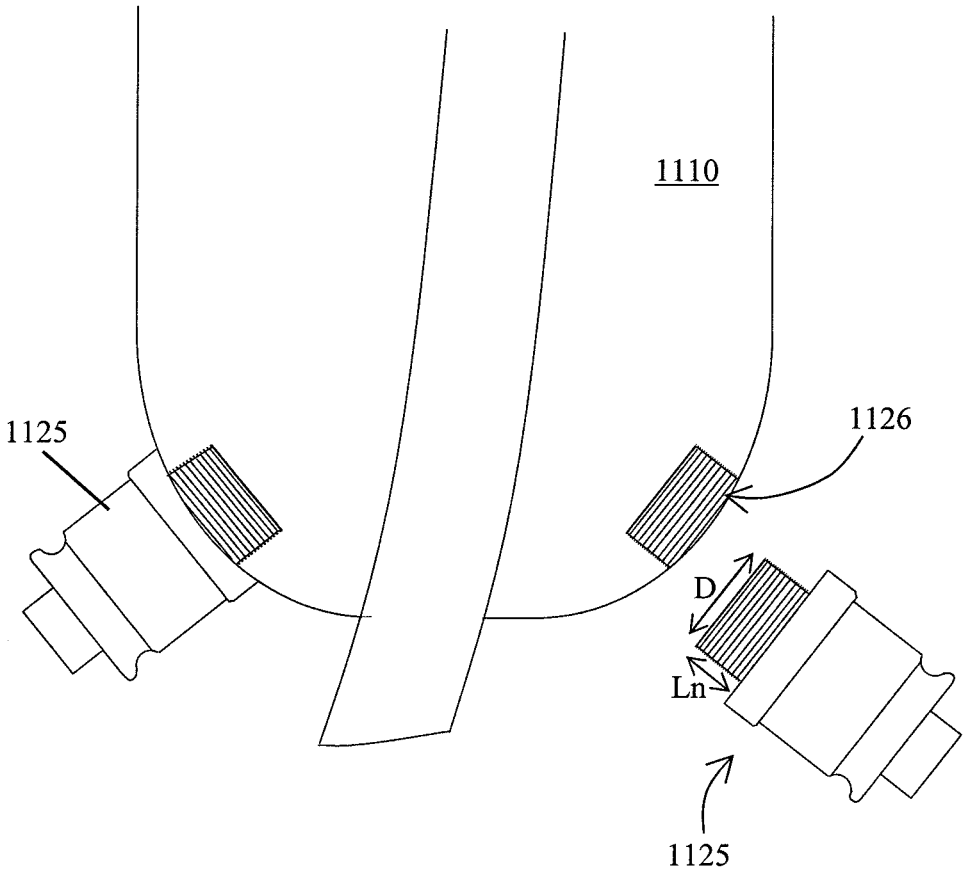
FIG. 11 shows a semi-schematic perspective of a hybrid bit according to an embodiment of the present disclosure.

Journals may be attached separately to a bit body by being welded to the bit body, screwed into the bit body, or both. For example, as shown in FIG. 11, a replaceable journal 1125 (i.e., a journal that may be replaced) may be screwed into a bit body 1110 via a threaded connection 1126 and then welded by any means known in the art. The threaded connection 1126 of a replaceable journal 1125 may have a dimension, such as diameter D and length Ln, based on the stress conditions surrounding points of connection between the replacement journal 1125 and the bit body 1110 to reduce and/or prevent failure of the replacement journal 1125. Length Ln may also be dependent on the thickness of the bit body and the placement of various hydraulic components. Further, it may be desirable for the diameter D to be close in value to the diameter of the journal. In some preferred embodiments, the ratio of the threaded connection length Ln to diameter D (Ln/D) may be more than 0.5. The threaded connection of a replacement journal may be welded from the plenum of a bit body (i.e., from the inside of the bit) and/or the replaceable journal may be welded around the connection with the outer surface of the bit body. Replaceable journals may be assembled to have self-contained lubricant systems with corresponding roller cones. Thus, reservoirs and lubricant passages may not be necessary for hybrid bits that are formed to receive replaceable journals.

In other embodiments, journals may be fitted and locked into journal assembly holes in the bit body. For example, as shown in FIGS. 13A-E, a separated journal 1325 may include a journal locking end 1350, a bearing end 1370, and a shaft 1360 extending between the bearing end 1370 and the journal locking end 1350, wherein the shaft 1360 has at least two circumferential grooves 1361, and a journal lube hole 1365 positioned between the two grooves 1361. A seal 1362, such as an o-ring, is fitted within each of the grooves 1361, thereby retaining any lubricant or grease flowing through the lube hole 1365 and closing the lubricant system to outside contaminants. As shown in FIG. 13E, the locking end 1350 of two or more journals 1325 may be fitted together within the bit body, such that the journal lube hole 1365 of each journal 1325 corresponds to a lubricant passage 1363, which extends from a grease reservoir 1364 through the bit body. Such journals may be manufactured by machining a journal made of machinable steel, such as 4715 or 8720 steel, to have a bearing end, a shaft with two grooves and a lube hole, and a locking end. The locking end is configured to fit with other journal locking ends such that the lube hole on each journal matches with a lubricant passage extending through a bit body.

Figure 13A:
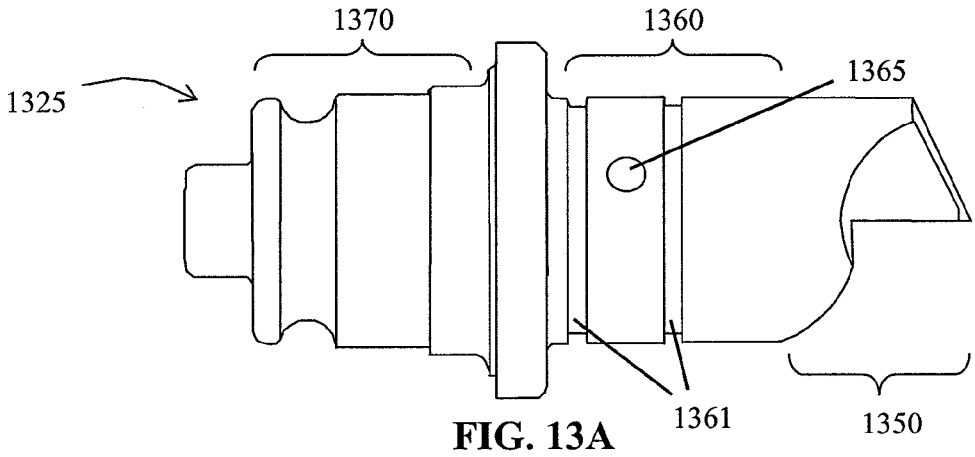
FIGS. 13A-E show side views of a journal according to some embodiments of the present disclosure.
Figure 13B:
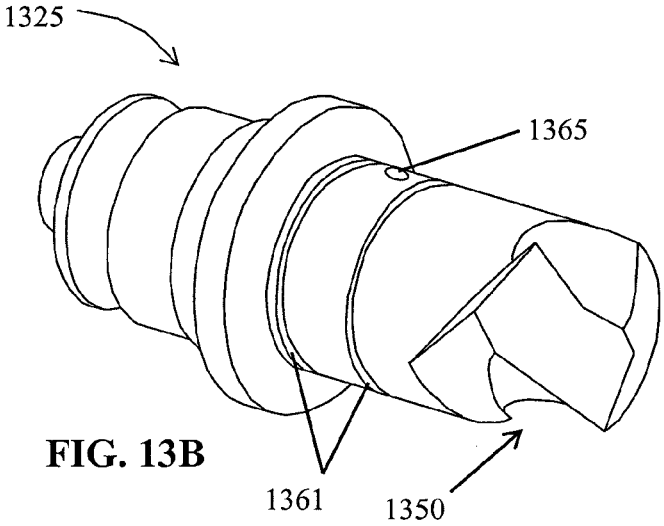
Figure 13C:
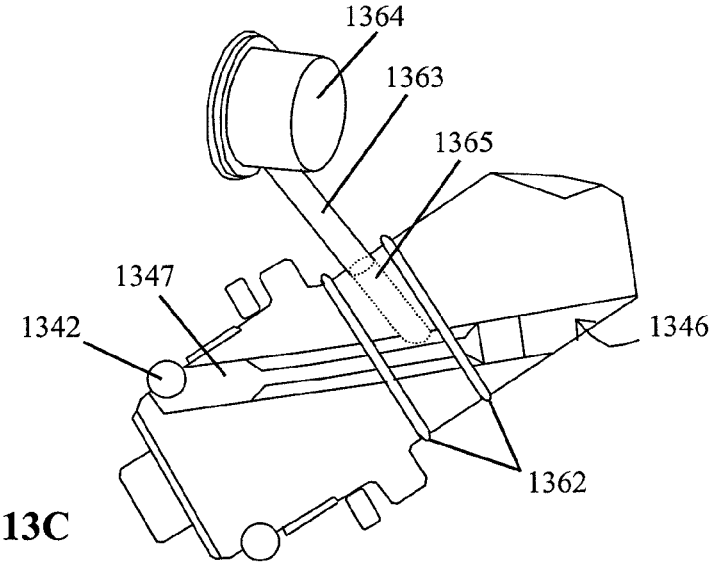
Figure 13D:
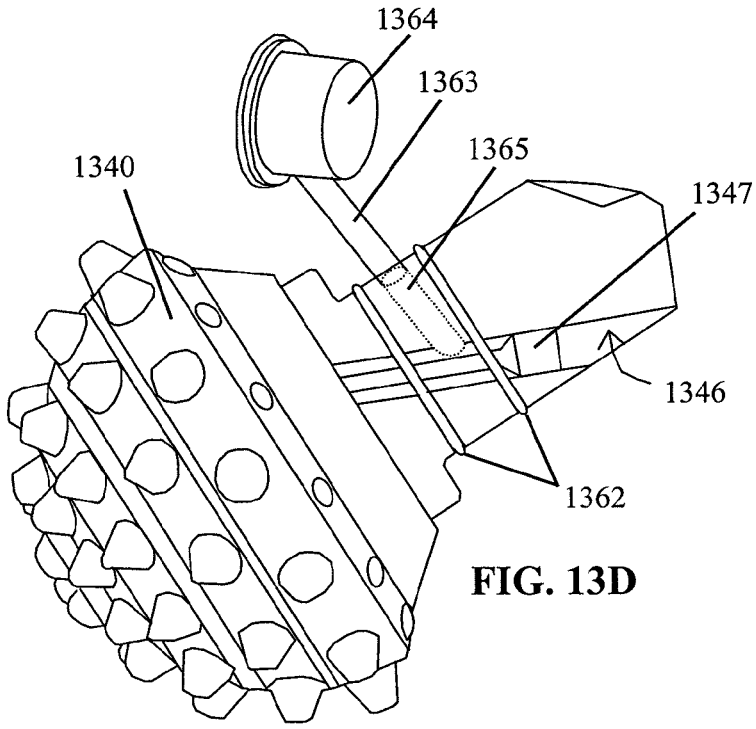
Figure 13E:
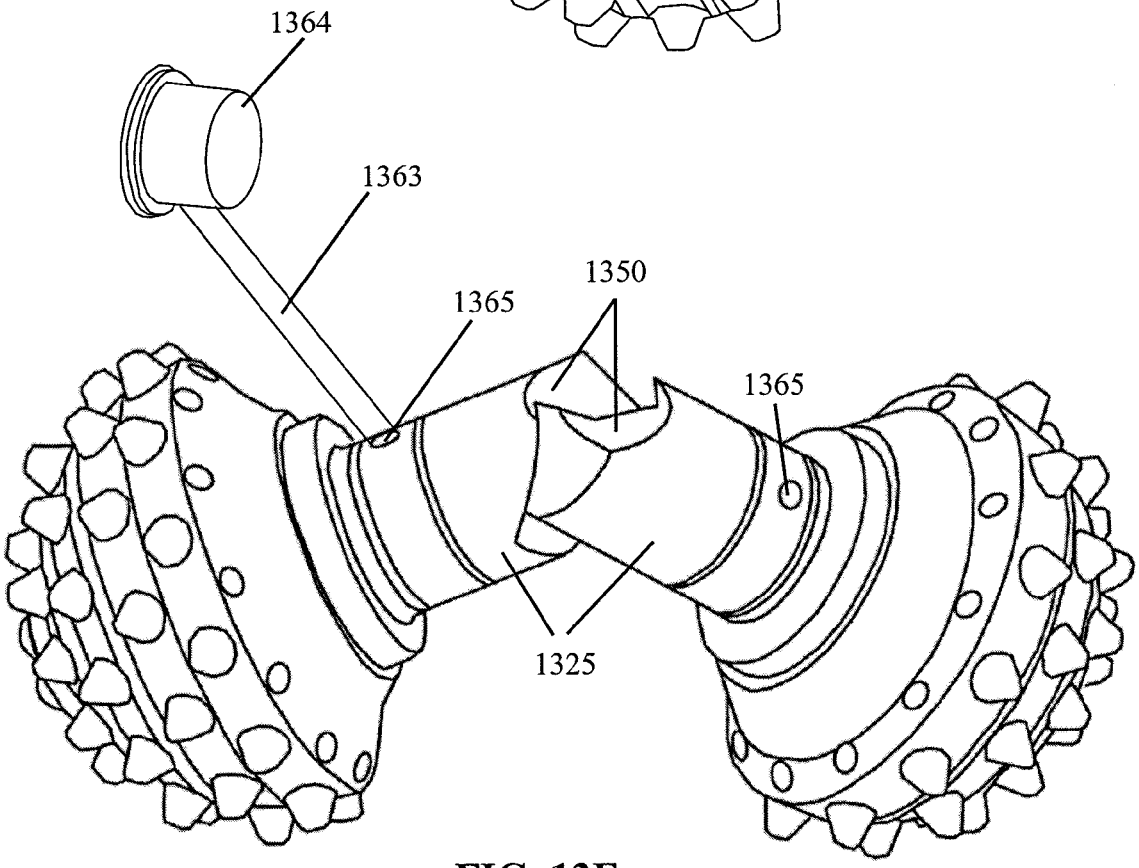

Referring to FIGS. 13C and 13D, cones 1340 may be mounted and retained on the journals 1325 by a ball bearing system, wherein a plurality of bearing balls 1342 are fitted into a ball race, formed by complementary ball race surfaces in the journal and cone. The balls 1342 are inserted through a ball passage 1346, which extends through an outer face of the bit body to the journal. A ball retainer 1347 is inserted into the ball passage 1346 after the balls 1342, and then secured in place, e.g., by a ball hole plug welded in place. Because the balls 1342 may be secured by a ball retainer and plug prior to inserting the journal 1325 into a drill bit journal assembly hole, cones 1340 (or discs) may be mounted on journals prior to or after the journals are attached to the drill bit.

Figure 15A:
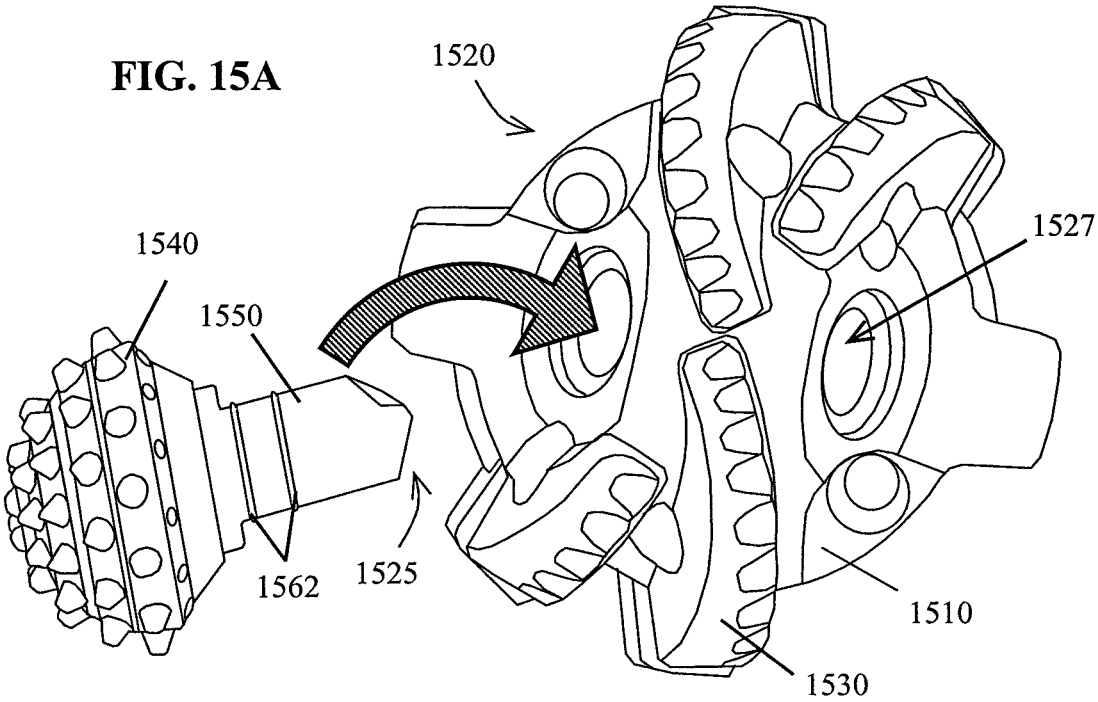
FIGS. 15A and 15B show a bottom and top view of hybrid bits according to embodiments of the present disclosure.
Figure 15B:
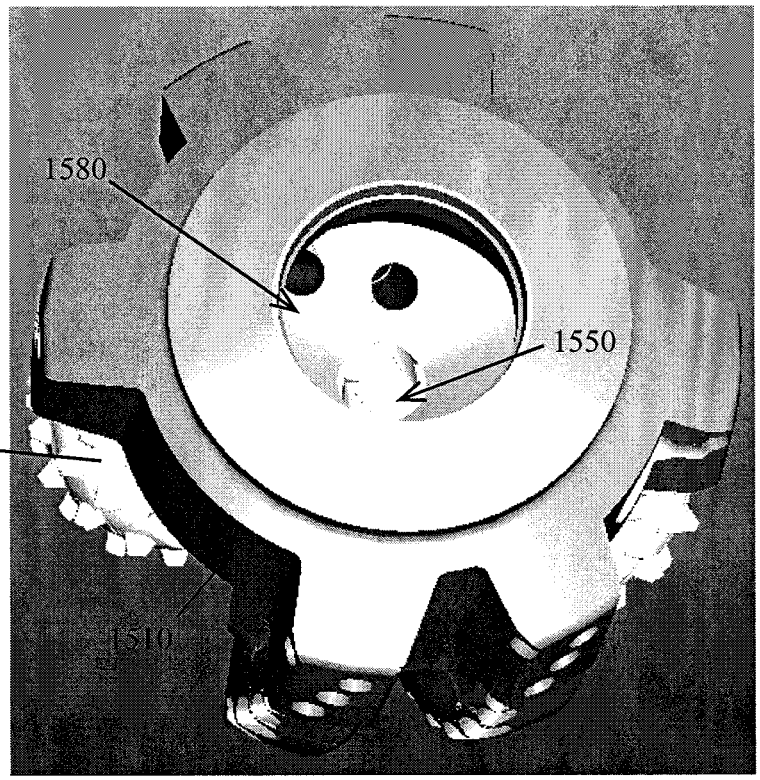

Embodiments of a hybrid drill bit having a locking journal, such as described above and shown in FIGS. 15A-B, may be formed by infiltrating, machining, or casting a bit body, wherein the bit body 1510 includes a threaded pin end (not shown) and a cutting end 1520. The bit body 1510 may be formed from steel, such as E4130 steel, or a metal matrix material, such as metal carbide particles dispersed within a metallic phase. Blades 1530 may be formed integrally with the bit body 1510, or alternatively, blades 1530 may be separately attached to the bit body 1510. Locking journals 1525 or mechanically locking journals may be attached to the cutting end 1520 of the drill bit 1510 such that the journals 1525 extend downward and radially outward from a longitudinal axis of the bit body 1510. The locking journals 1525 may be attached to the drill bit 1510 by inserting each locking journal 1525 into journal assembly holes 1527 in the cutting end of the bit body, such that the locking end 1550 of each journal fits together within the bit body. As seen in FIG. 15B, the locking ends 1550 of the locking journals 1525 may then be welded together from within the plenum 1580 of the drill bit. Advantageously, the locking ends 1550 are configured such that the lube hole (not shown) on each journal corresponds to a lubricant passage extending from a grease reservoir through the bit body. Seals 1562, such as o-rings, are positioned within the grooves on each journal to retain grease or lubricant passing from the lubricant passage to the lube hole. A roller cone 1540 (or a roller disc) may then be mounted on each journal 1525. Alternatively, cones or discs may be mounted to each journal 1525 prior to inserting the journals into journal assembly holes 1527 in the drill bit.

Figure 12A:
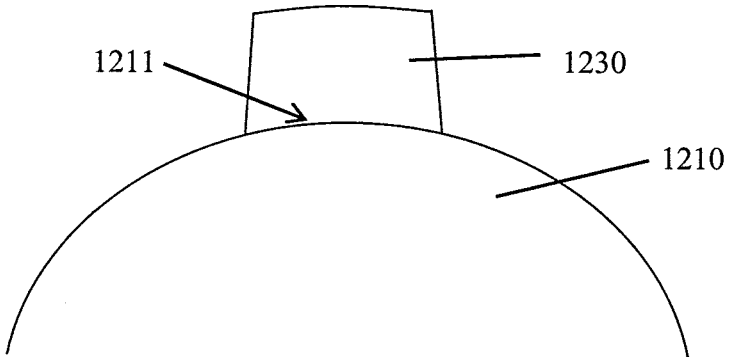
FIGS. 12A-C show cross-sectional partial views of hybrid bits according to some embodiments of the present disclosure.
Figure 12B:
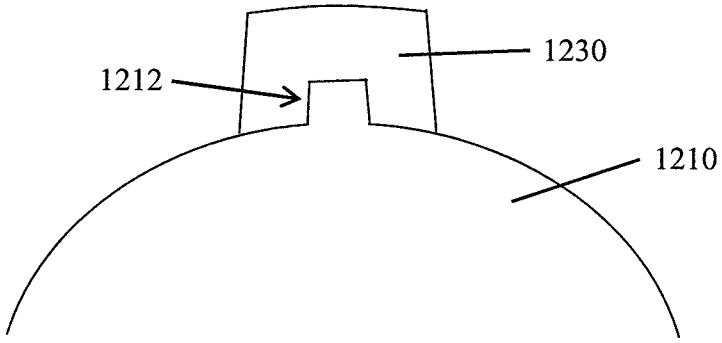
Figure 12C:
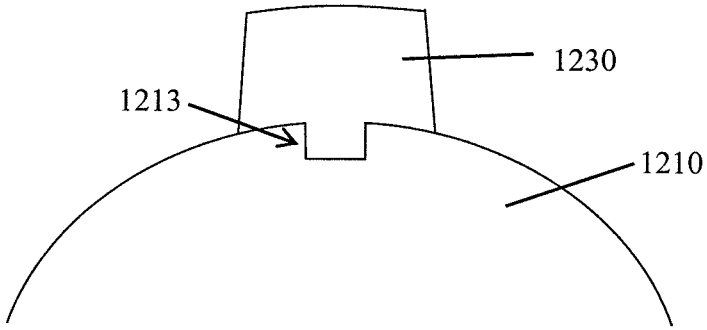

Blades that are formed with a steel bit body in a mold may be formed from any steel that is suitable for the bit body. However, blades that are attached to the steel bit body may be formed from tungsten carbide or steel including, for example, mild to high carbon steel, such as steel comprising at least 0.3% carbon by weight. Referring now to FIGS. 12A-C, blades 1230 may be attached separately to a bit body 1210 by being welded to a flat bit body surface 1211, or by being fitted to a keyed shaft (i.e., a ridge or protrusion) 1212 or into a keyway (i.e., a groove or depression) 1213 to secure the connection between the blade 1230 and bit body 1210 as the blade is welded into place. Blades may be welded to the bit body by any means known in the art, including, for example, friction stir welding, electron beam (EB) welding, oxyacetylene torch welding, etc. In one embodiment, blades comprising a tungsten carbide matrix material may be EB welded to the bit body using an intermediate welding material. EB welding allows attachment of the blade to the bit body through localized/directed heating. In embodiments having blades attached to a bit body, it may be desirable to braze blade cutting elements onto the blade before attaching the blade to the bit body. Further, it may be desirable to braze blade cutting elements onto a blade that is integral with a bit body before welding journal(s) to the bit body.

In other embodiments, the bit body may be formed from a matrix material, such as a tungsten carbide matrix material. Bit bodies formed from a matrix material may be formed in a mold such that one or more blades are integral with the bit body (i.e., the bit body and the one or more blades are formed from a single matrix material together in a mold) and journals may be separately attached thereto. Advantageously, by forming a matrix material bit body and one or more blades integrally in a mold, the bit may have increased material uniformity. In particular, blades formed integrally with a bit body may have less connection weaknesses that may be present when blades are attached to a bit body. In some embodiments, at least 50% or at least 75% of a bit body formed in a mold with one or more blades comprises matrix material. In other embodiments, substantially all of a bit body (excluding journals) formed in a mold with one or more blades comprise matrix material. The amount of matrix material may depend on the number of cones attached to the bit body. For example, matrix bit bodies may be formed with a central "steel blank," and hydraulic components, and optionally with steel blanks to receive a journal threading or welding. Alternatively, the journals may be received by a matrix material that is machinable or has cast threading in which case the entire bit body except for the central steel blank, hydraulic components, and journals are formed of a matrix material.

The amount of matrix material in bits formed with steel blank to accept journals may be less than, for example, the amount of matrix material in bits having journals threaded directly into the matrix bit body with cast threading.

Journals may be separately attached to a matrix bit body by being welded to the bit body, screwed or fitted into the bit body, or a combination of both. For example, a replaceable journal may be screwed into a matrix bit body and then welded around the perimeter of the journal on the outer surface of the bit body, or by welding the journal from the plenum inside the bit body, or a combination of both. In one embodiment, a journal may be screwed into a region of a matrix bit body that has been formed of a machinable material (e.g., tungsten powder). Selective placement of machinable material within a matrix bit body may be achieved by the methods described in U.S. Publication No. 2009/0283333, which is herein incorporated by reference. If there is component failure or if the bit body is being repaired for additional runs, the replaceable journal may be replaced by cutting out the failed journal, adding new machinable material, re-machining threads, screwing in a replacement journal, and welding to secure in place.

Referring back to FIGS. 4A and 4B, roller cone 440 extends downward and radially outward from the longitudinal axis L of bit 400 such that an acute angle $\phi$ is formed between journal axis R (axis about which roller cone rotates) and longitudinal axis L about which bit 400 rotates. According to various embodiments of the present disclosure, $\phi$ may broadly range from 15 to 70 degrees. However, in particular embodiments, $\phi$ may range from any lower limit of 40, 45, 50, 60 or 65 degrees to any upper limit of 60, 65, or 70 degrees. One skilled in the art should appreciate that the journal angle (as that term is used in the art) is related to $\phi$. In particular, the journal angle is defined in the art as the angle formed by a line perpendicular to the axis of a bit and the axis of the journal and thus may be equal to 90-$\phi$. Selection of $\phi$ (and journal angle) may be based factors such as the particular blade profile selected, the relative cone size (and desired cone size), the type of cutting action desired (shearing, scraping, rolling), formation type, the number of cutting elements desired to contact the bottom hole at one time, desired cone rotation speed, desired shear/indention ratio, desired core size, etc. For example, in a soft formation (where greater shearing is desired), it may be desirable for $\phi$ to range from 60 to 70 degrees whereas in a hard formation (where greater rolling is desired), it may be desirable for $\phi$ to range from 50 to 60 degrees. However, in particular embodiments, the journal angle may be primarily determined such that the roller cone cutting profile matches the blade cutting profile.

While FIG. 4A shows the angle $\phi$ for a single journal, one skilled in the art should appreciate after learning the teachings related to the present invention contained in this invention, that each journal may form an acute angle $\phi 1$, $\phi 2$, etc. with respect to the longitudinal axis L of the bit, which may be the same or different from the other journals. Journals 425 may also extend from different axial locations of bit body 410. For example, in an embodiment having three blades and three roller cones in an alternating arrangement, one journal 425 may be axially distanced (e.g., placed higher on the bit body 410) from the other two journals 425. Such axial separation may be measured from any two points on the journal, such as the nose of the journal. Further, depending on such configurations (differing acute angles $\phi$ and/or axial separation, blade placement), it may also be desired to have different relative sizes of roller cones 440.

Cone sizes may differ with respect to one or more of a cone's outer radius, nose projection, radius of curvature, etc. The size of a roller cone may depend on how much room is on the bit body, and in particular, the number of blades and roller cones. For example, a bit body having one roller cone and two blades may have a larger roller cone than a bit body having three roller cones and three blades. Further, the load on each cone depends mainly on the total number of blades and cones. Thus, in a particular embodiment, it may be advantageous to use smaller roller cones and fit more roller cones and blades on the bit body in order to decrease load on each cone. Decreasing the load on a roller cone may help to increase the bearing life of the roller cone. Additionally, smaller roller cones may have a faster rate of rotation.

Figure 5:
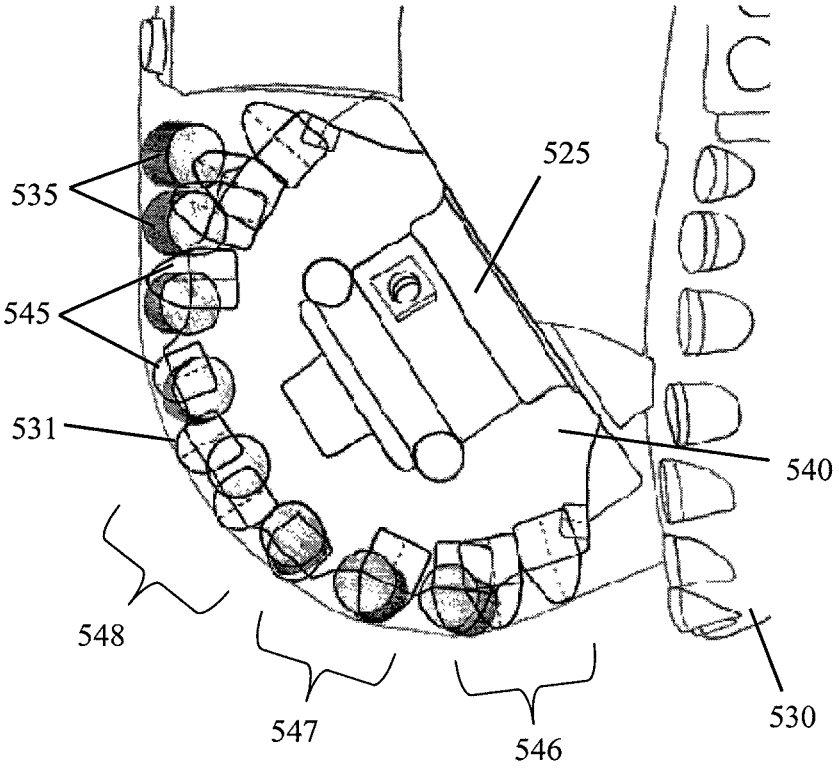
FIG. 5 is a schematic perspective of part of a hybrid bit according to an embodiment of the present disclosure.

In an exemplary embodiment of the present disclosure, as shown in FIG. 5, the alignment of a journal 525 (e.g., journal angle) and the size and shape of a roller cone 540 mounted to the journal 525 are configured so that the cutting profile 531 of the roller cone 540 corresponds to the cutting profile of the blade 530. The roller cone cutting profile 531 may be divided into a cone region 546, a nose region 547, and a shoulder region 548, which correspond to the cutting elements overlapping with those respectively termed regions of blade 530. The outwardly facing feature of the roller cones allows the cutting profile of a roller cone to match the blade cutting profile. By using such a configuration, the roller cone cutting elements 545 may have the same contact point with the workpiece that blade cutting elements 535 would have had if a blade 530 was in the place of the roller cone 540. Thus, a hybrid bit according to the embodiment shown in FIG. 5 may fit into the space of a PDC bit, but simultaneous crushing or gouging (from the roller cones 540) and pure shearing (from the blades 530) actions of rock cutting are capable. Further, in preferred embodiments, the alignment of a journal (e.g., journal angle) and the size and shape of a roller cone mounted to the journal may be configured so that at least 60% of the roller cone cutting profile contacts the bottom of the formation (i.e., working surface). In particular embodiments, 60-70% of a roller cone cutting profile may contact the working surface.

It may be desirable for some embodiments to have at least one region 546, 547, 548 of a roller cone cutting profile 531 offset a distance from the cutting profile of a blade 530. In particular, the offset distance may allow roller cone cutting elements 545 to gouge or weaken the working surface of a formation, thereby loosening or cracking the formation. The blade cutting elements 535 may then shear away the formation more efficiently and effectively. Thus, having an offset distance Further, one skilled in the art should appreciate that the present disclosure is not limited to bits having three cones and three blades, but equally applies to bits having any number of multiple cones and blades, including for example, two cones and two blades, four cones and four blades, two cones and four blades, or three blades and one cone, etc. One skilled in the art should appreciate after learning the teachings related to the present invention contained in this invention that the angle between cones and/or blades may depend, in some part, on the number of cones and blades on a bit, but may also depend on other desired cone and/or blade separation angle variances, the arrangement of the blades with journals/cones, etc. For example, in embodiments having pairs of blades separated by a journal, the blade separation angle may be smaller between the two blades in a pair and larger between the pairs.

Additionally in accordance with various embodiments of the present disclosure, as shown in FIGS. 7A-7D together, a roller cone 740 may be retained on a journal 725 through a unique ball bearing retainer system. Specifically, a plurality of bearing balls 742 are fitted into a ball race, formed by complementary ball race surfaces 743*a*, 743*b* in the journal 725 and cone 740, respectively, to retain cone 740 on journal 725. These balls 742 are inserted through a ball passage 746, which extends through an outer face 712 of the bit body 710 to journal 725 between the bearing race surfaces 743*a* and 743*b*.

Figure 7A:
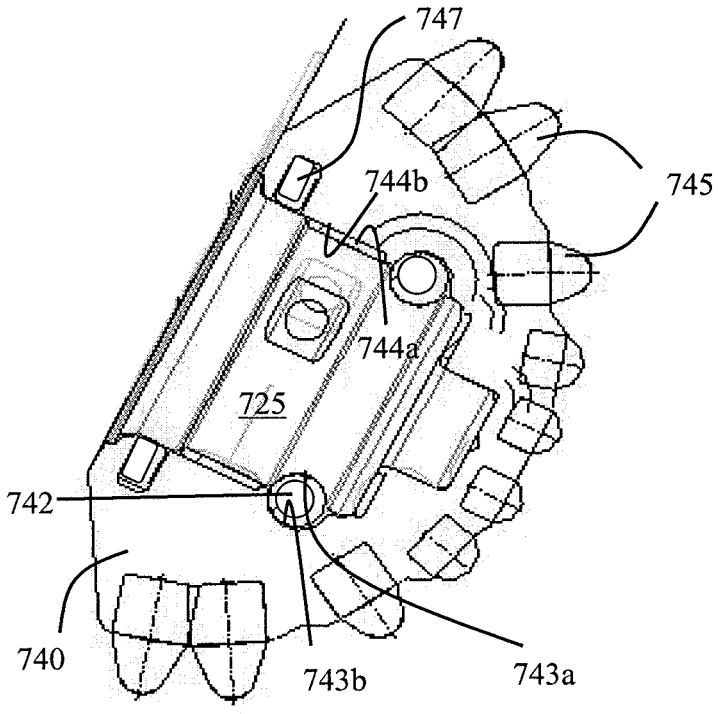
FIG. 7A is a schematic of a roller cone retained on a journal according to one embodiment of the present disclosure.
Figure 7B:
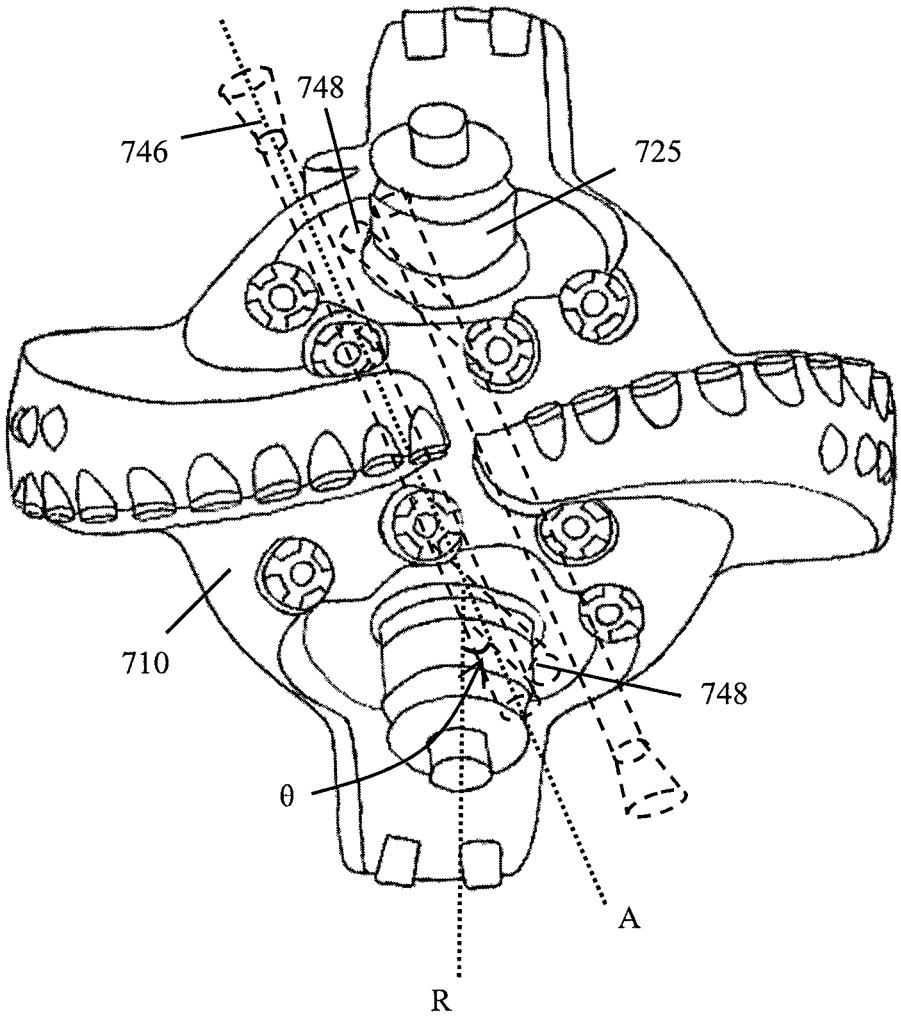
FIG. 7B is a bottom view and partial schematic perspective of a hybrid bit according to another embodiment of the present disclosure.
Figure 7C:
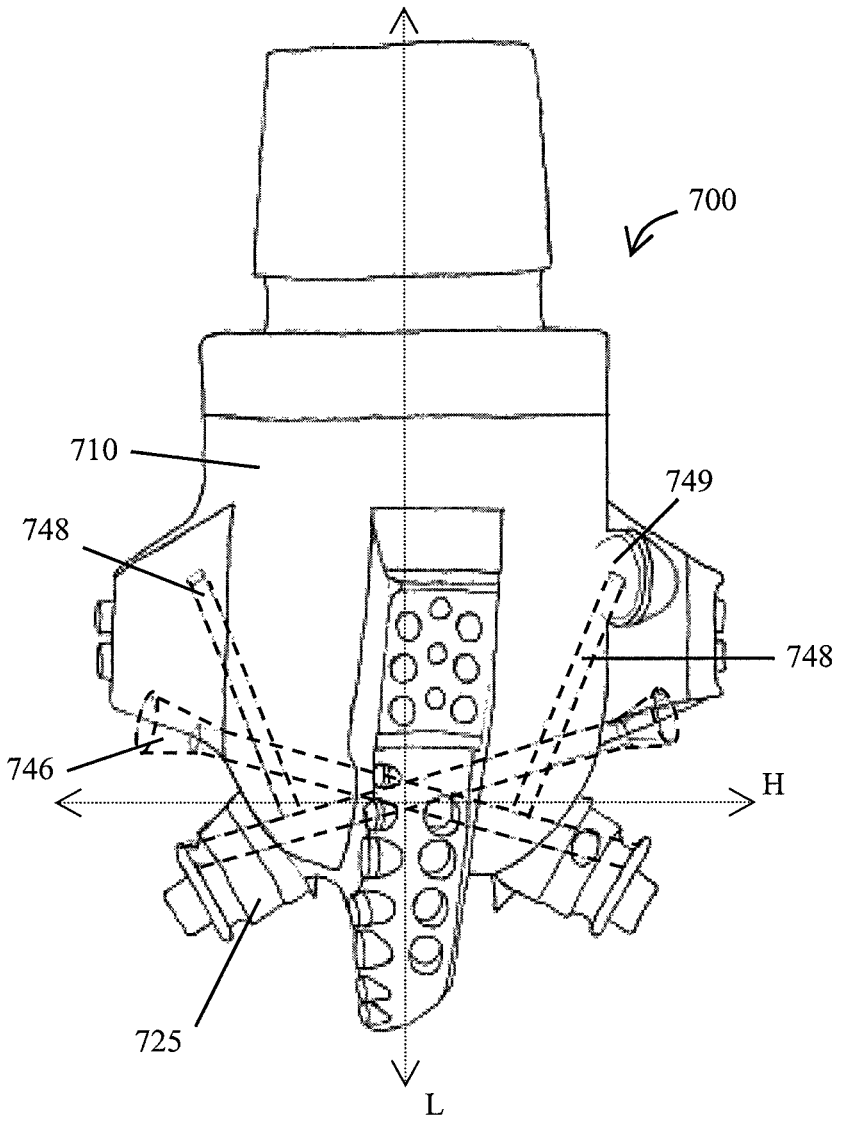
FIG. 7C is a side view and partial schematic perspective of a hybrid bit according to another embodiment of the present disclosure.
Figure 7D:
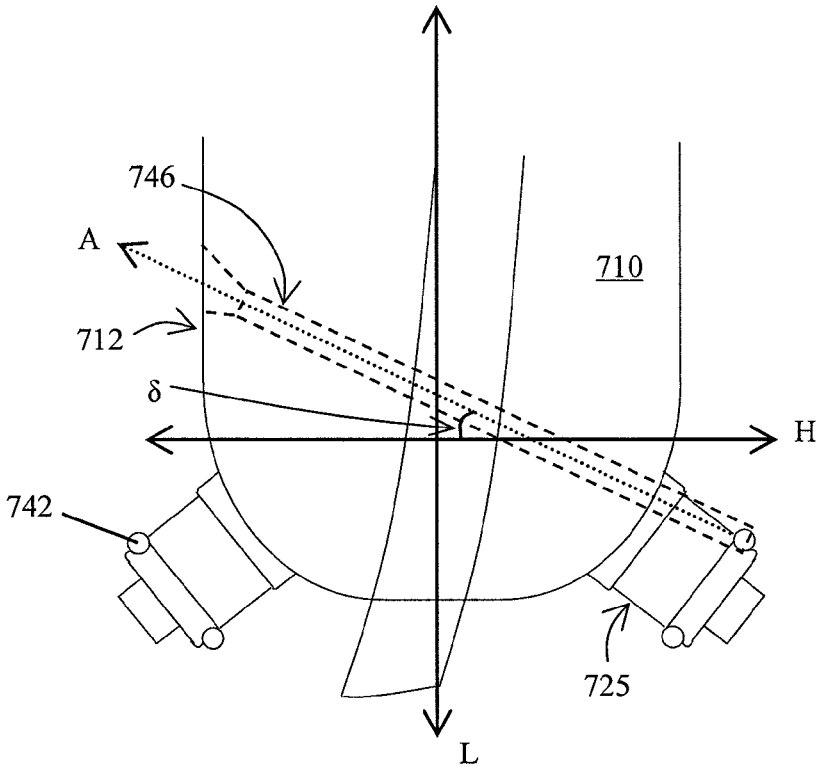
FIG. 7D is a schematic side view of a hybrid bit according to another embodiment of the present disclosure.
Figure 7E:
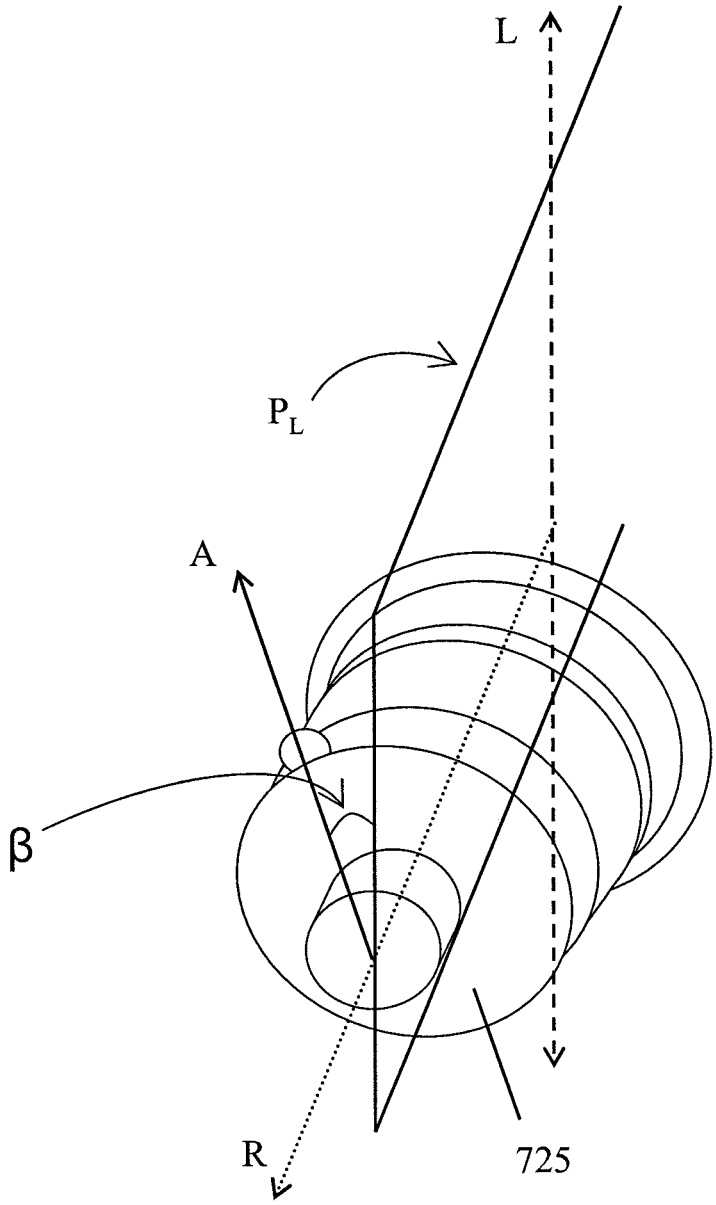
FIG. 7E shows a journal according to an embodiment of the present disclosure.

As shown in FIG. 7B, the ball passage 746 has a ball passage center axis A that intersects a journal axis R such that the ball passage center axis A forms an acute angle θ with journal axis R. In a preferred embodiment, the acute angle θ may be equal to about 25°. Other acute angle θ values may be determined based on different amounts and locations of compressive stresses formed between the journal, roller cone, and/or ball passage, and may range from 20° to 40°. As shown in FIG. 7E, the ball passage also forms an angle β with a journal 725. The angle β is defined on a plane parallel to the journal 725 (and perpendicular to the journal axis R) as the angle of a ball passage center axis A from a plane $P_L$, which intersects the journal axis R and longitudinal axis L of the bit body. The angle β may range from greater than 0 degrees to 45 degrees. In a preferred embodiment, the angle β is no greater between the blade and roller cone cutting profiles may allow for a faster rate of penetration. In some embodiments, the offset distance may be between 0.02 and 0.08 inches. In a preferred embodiment, the offset distance may be about 0.05 inches.

Figure 6:
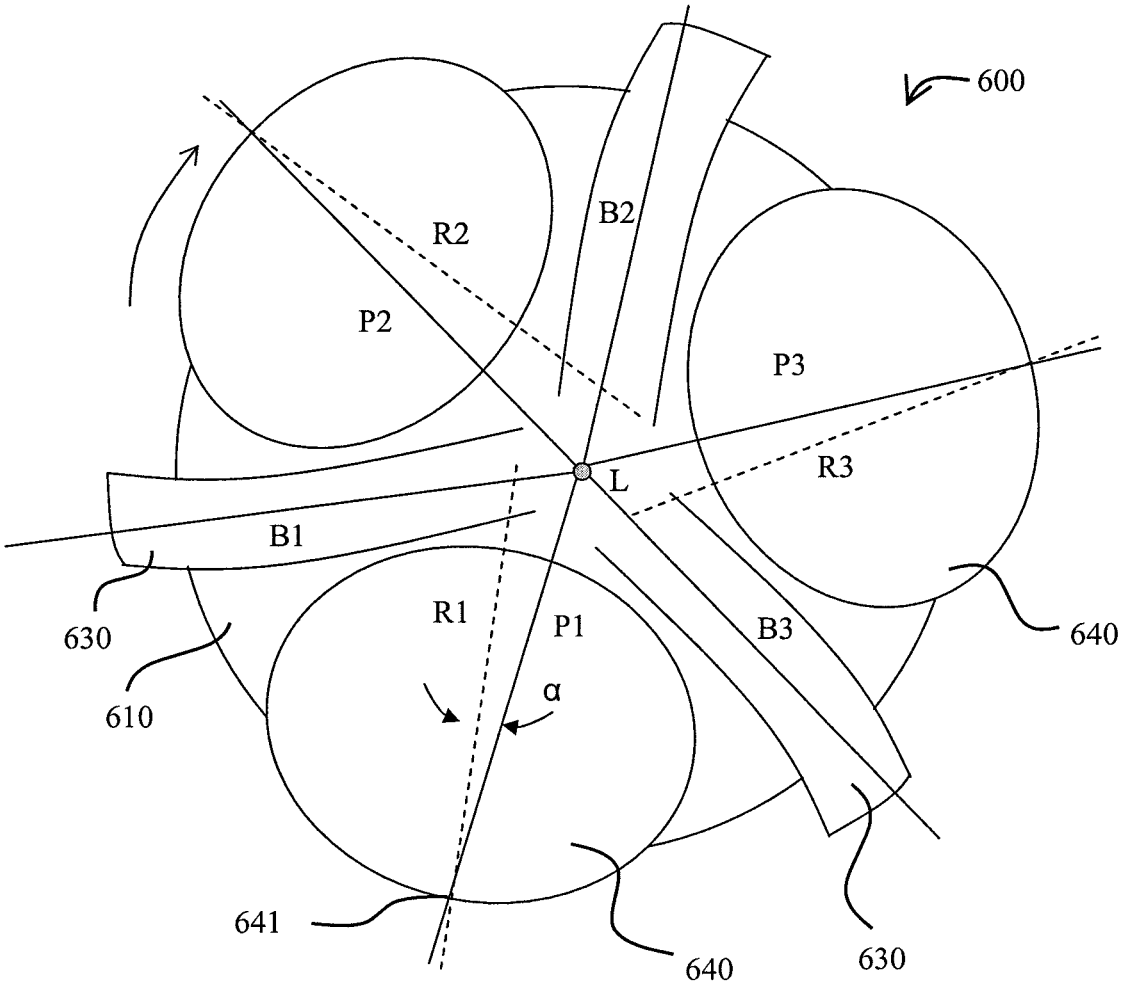
FIG. 6 is a schematic perspective of a hybrid bit having three blades and three roller cones according to an embodiment of the present disclosure.

In some embodiments, as shown in FIG. 6, the journals (not shown) and cones 640 may be provided with an offset. Journal/cone offset can be determined by viewing the drill bit from the top on a horizontal plane that is perpendicular to the center axis L. Offset, represented as α, is the angle between a journal axis R and a line P on the horizontal plane that intersects the longitudinal axis L and the nose 641 of cone 640. A positive offset is defined by an angle opening with the direction of rotation of the drill bit. A negative offset is defined by an angle against the direction of rotation of the drill bit. As shown in FIG. 6, a positive offset is provided for each cone 640. However, in other embodiments, any combination of positive and/or negative offsets or only negative offsets may be used. In a particular embodiment, any number of cones (one or more or all) may be provided with zero or no offset, different offset directions and/or different magnitudes of offset. For example, in embodiments where one cone is larger than the others, it may be desirable for the larger cone to at least have a different magnitude of offset.

Additionally, cone offset may be used alone or in combination with varying cone separation angles (angle between journal axis R1, R2, and R3 (or P1, P2, or P3)). Specifically, when a journal axis is offset or skewed with respect to the centerline of the bit, the cone separation angle may be determined by the angle formed between two lines P (e.g., P1 and P2) on the horizontal plane that intersect the center axis L and the nose 641 of cone 640. The bit 600 shown in FIG. 6 has three cones 640 and three blades 630. Each cone 640 has a cone separation angle of 120° when projected upon a horizontal plane that is perpendicular to the center axis L of the drill bit. However, in other embodiments the cone separation angles need not be uniform. The blades 630 may also be positioned around the bit body 610 such that blade separation angles (angle between B1, B2, and B3) are equal or non-equal. than 45 degrees to reduce the amount of stress encountered by the ball passage. Further, as seen in FIG. 7D, a ball passage center axis A intersects a horizontal plane H such that the ball passage center axis A forms an acute angle δ with horizontal plane H. The acute angle δ may approximately be determined based on the relationship 90-ϕ-20. Thus, in an embodiment wherein the journal angle (90-ϕ) ranges from about 20 to 40 degrees, the acute angle δ may range from about 0 to 20 degrees. Horizontal plane H is perpendicular to the longitudinal axis L, and may be located at a distance along the bit body 710.

A cone 740 is first fitted on a journal 725, and then balls 742 are inserted through ball passage 746 to fit in the ball race. Balls 742 are retained in the ball race by a ball retainer (not shown), which is inserted into passage 746 after balls 742, and then secured in place (such as by a plug welded in place). The balls 742 carry any thrust loads tending to remove the cone 740 from the journal 725 and thereby retain the cone 740 on the journal 725. In some embodiments, the ball passages 746 may intersect near the bit centerline (depending on bit size, cone number, etc.). However, advantageously, hybrid bits according to the present disclosure are also capable of having ball passages 746 that do not intersect by adjusting angles θ and/or β because there is more room in the bit body.

Lubricant passages 748 are provided from grease reservoir 749 to bearing surfaces 744*a*, 744*b* formed between a journal 725 and cone 740, respectively. A lubricant or grease composition fills the regions adjacent the bearing surfaces 744*a*, 744*b*, lubricant passages 748 (and a portion of ball passage 746), and a grease reservoir 749 located at the exterior of bit 700 above journal 725. Lubricant or grease is retained in the bearing structure by a resilient seal 747 within a seal gland formed between the cone 740 and journal 725. Grease reservoir 749 may be located at a height of the bit body 710 such that the lowermost end of grease reservoir 749 is at least 25 percent of the total bit body height and no more than 50 percent of the total bit body height.

In another aspect, embodiments disclosed herein relate to hybrid drill bits having blades and roller disks, which may be arranged in an alternating configuration. Similar to the hybrid drill bits having blades and outwardly facing roller cones described above, the roller disks may be assembled outwardly. Due to the special shape and arrangement of the roller disks that have a negative journal angle, roller disks can be fit into the space of a conventional PDC bit. Further, in this bit, simultaneous crushing and pure shearing actions of rock cutting may be achieved. The roller disks differ from the roller cones described above in that the disks are "flatter" than a conventional cone and may have fewer cutting elements thereon.

Figure 8A:
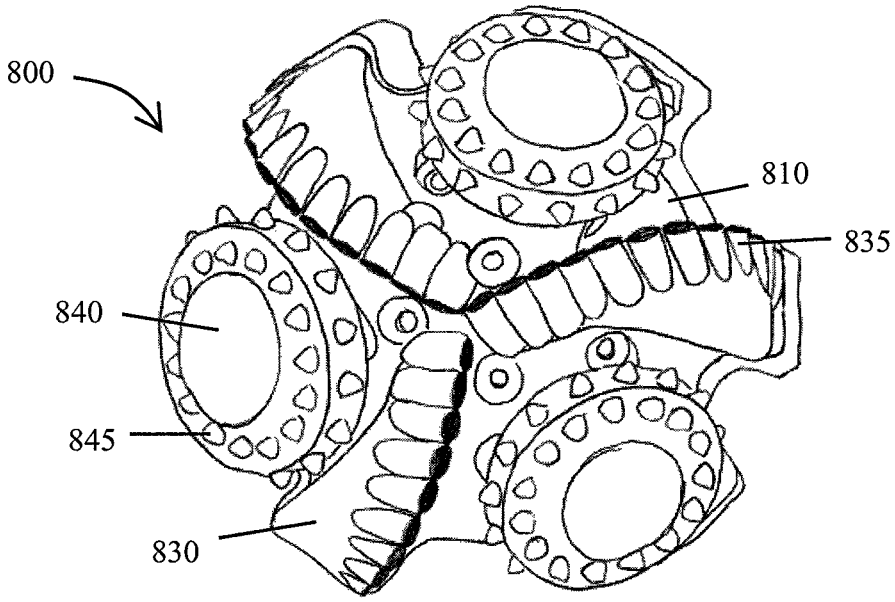
FIG. 8A-B shows a bottom and side view of a hybrid bit according to one embodiment of the present disclosure.
Figure 8B:
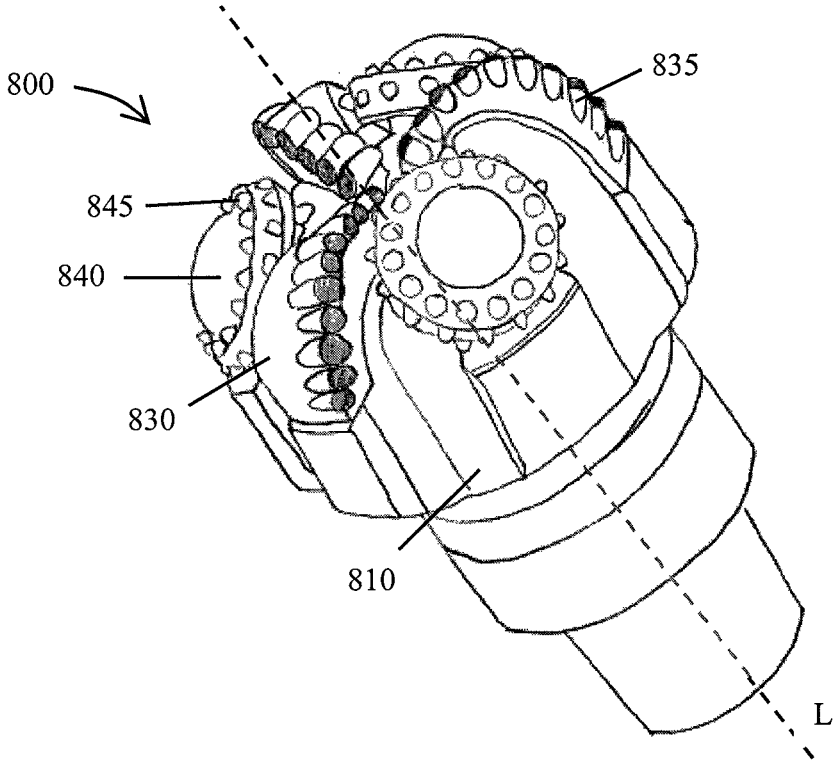

Referring to FIGS. 8A and 8B, a hybrid bit 800 according to an embodiment of the present disclosure is shown, wherein the rolling cutters are roller disks. A hybrid drill bit 800 has a bit body 810 having a plurality of cutting blades 830 and a plurality of roller disks 840 positioned in an alternating arrangement about the longitudinal axis L of the bit 800. A plurality of blade cutting elements 835 is disposed on each blade 830, and a plurality of roller disk cutting elements 845 is disposed on each roller disk 840. Roller disks 840 may be held to the bit body 810 on a journal (not shown), using a ball bearing system (e.g., a ball bearing system such as the one described for roller cones). A journal is positioned on the bit body 810 such that the axis of the journal forms a disc journal angle relative to the longitudinal axis L of the bit 800. According to some embodiments, it may be desirable for the disc journal angle to be determined such that the roller disk cutting elements 835 align with the cutting profile of a blade in the shoulder region. Disc journal angles may be the same as roller cone journal angles, described above. For example, in particular embodiments, the disk journal angle may range from any lower limit of 20, 25, or 30 degrees to any upper limit of 25, 30, 40, 45, or 50 degrees. Further, journals used with roller disks may be shorter than journals used with roller cones.

Additionally, in some embodiments, replaceable (twist-in) journals may be used with roller disks.

Various embodiments of the present disclosure may include different arrangements of the cutting elements on the blades and on the rolling cutters (i.e., roller cones or roller disks). As used herein, cutting elements on blades, roller cones, and roller disks are all identified according to blade location terminology. In particular, blade cutting elements may be identified by their placement along the blade, in the cone region, the nose region, the shoulder region, and the gage region of the blade. Roller cone and roller disk cutting elements may also be identified according to corresponding blade location. For example, referring back to FIG. 5, a roller cone cutting profile corresponds to the cutting profile of a blade such that each roller cone cutting element region 546, 547, 548 corresponds to the blade cone, blade nose, and blade shoulder regions, respectively.

Cutting elements may have cutting element geometries specifically tailored to the placement on the cone, disk, or blade. For example, roller cone cutting elements in a cone region may have the greatest extension height, roller cone cutting elements in a shoulder region may have the lowest extension height, and cutting elements in a nose region may have an extension height there between. As used herein, extension height refers to the height of the cutting element from the surface of the cone/disk/blade surrounding the cutting element to the apex of the cutting element. The extension height of cutting elements in different regions may also be varied to create an offset distance, as described above. For example, the extension height of roller cone cutting elements in the shoulder region of a roller cone may be larger than the extension height of blade cutting elements in the shoulder region of a blade, such that there is an offset distance between the cutting profile of the roller cone and the cutting profile of the blade in the shoulder region. In this manner, the number roller cone cutting elements that contact the shoulder region of a wellbore, where the greatest wear of blade cutting elements in a PDC bit is observed, may be increased.

Cutting element geometries may also vary in terms of the shape, diameter, or other measurement of size, etc. depending on the region the cutting elements are located in on a particular blade, cone, or disk. Further, cutting element geometries may vary depending on whether the cutting elements are located on a blade or on a roller cone or roller disk. Examples of various roller cone cutting element sizes and geometries may be found in U.S. Application No. 61/230,497, which is hereby incorporated by reference. Examples of various roller disk cutting element structures and arrangements are described in U.S. patent application Ser. No. 11/232,434, which is hereby incorporated by reference.

Additionally, roller cone and roller disk cutting elements may include milled tooth cutting elements and/or insert type cutting elements. Further, roller cone and roller disk cutting elements may be formed from metal carbides, such as tungsten carbide, polycrystalline diamond, polycrystalline boron nitride, or other hard or super hard material known in the art, or combinations thereof. For example, one or more rows of cutting elements may include a tungsten carbide base and a diamond enhanced tip or may be formed entirely of diamond (including thermally stable polycrystalline diamond).

In other embodiments, the blade cutting elements may vary in structure and arrangement. For example, as shown in FIGS. 8A and 8B, each blade 830 on a hybrid drill bit 800 may have one row of blade cutting elements 835. However, a blade may have more than one row of blade cutting elements disposed thereon. Referring back to FIGS. 4A and 4B, two rows of blade cutting elements 435 are fixed to each blade 430. The blade cutting elements may include, for example, polycrystalline diamond compact (PDC) cutters, PCBN cutters, and other ultra hard cutters known in the art.

Further, the blade cutting elements may be arranged on the one or more blades of a hybrid bit according to embodiments of the present disclosure in various distributions. For example, the blade cutting elements may be arranged in a single set distribution, such that there is a cutting element in each radial position on the one or more blades (i.e., each cutting element has a unique radial position). Blade cutting elements arranged in a single set distribution may positioned in a single set forward spiral distribution (i.e., each radial position is filled in a clockwise direction) or single set reverse spiral distribution (i.e., each radial position is filled in a counterclockwise direction). Alternatively, the blade cutting elements may be arranged in a plural set distribution, wherein two or more cutting elements have identical radial positions.

Embodiments of the present disclosure may have various hydraulic arrangements to direct drilling fluid from the drill string to outside of the bit. Specifically, drilling fluid is directed within the hollow pin end of a bit to an interior plenum chamber formed in the bit body. The fluid is then directed through a hydraulic fluid passageway out of the bit through the one or more nozzles on the bit. In some embodiments, there may be at least one nozzle spaced between each pair of a neighboring cone and blade; however, in other embodiments, one or more nozzles may be omitted from between one or more pairs of neighboring cones and blades. Further, in particular embodiments, there may be two nozzles provided between at least one pair of a neighboring cone and blade. Nozzles may be individually oriented based the desired hydraulic function: cutting structure or cone/blade cleaning, bottom hole cleaning, and/or cuttings evacuation. Examples of nozzle orientation may be found in U.S. Provisional Application No. 61/230,497, which is incorporated herein by reference.

Compared with prior art hybrid bits (e.g., hybrid bits having inwardly facing rolling cutters), the hybrid bit of the present disclosure offers the following potential advantages. The use of an outwardly directed journal may provide for a complex trajectory that may combine crushing/indentation and shearing, increasing the efficiency in cutting a rock formation. The outwardly directed journal configuration combined with cutting blades may further contribute to higher inner cutting efficiency due to more compatible cutting mechanisms in PDC blades and high shear rolling cutters (e.g., outwardly facing roller cones) when compared to prior art embodiments having inwardly facing rolling cutters (roller cones or roller discs). More compatible shearing cutting mechanisms from an outwardly facing rolling cutter (roller cone or roller disk) to that of the shearing action from blade cutting elements may reduce vibration in the hybrid bit. For example, the amount of vibration is much less sensitive to formation changes and there is relatively better vibration behavior in curve drilling applications (when compared to prior art vibration behavior). Thus, there may be relatively less axial vibration in outwardly facing cone hybrid bits of the present disclosure than in inwardly facing cone hybrid bits. Less axial vibration helps to increase the cutting life of PDC cutters, which may be found on the blades of hybrid bits.

Use of the outwardly facing cones may also allow for stronger cone retention and minimized stress on the journal and bit body (the journal is on the bit body rather than a leg), as well as alleviate concern of leg failure that is present with bits having inwardly facing journals. Thus, other advantages of outward cone hybrid bits of the present disclosure may include better cone retention and stronger bearing/journal systems when compared to prior art bits having inwardly facing cones (e.g., hybrid bits with inwardly facing cones and conventional roller cone bits). Embodiments of the present disclosure also provide higher rates of penetration when compared to prior art hybrid bits.

The arrangement may also provide a bit that is suitable for directional drilling and that holds good tool face angle during drilling (i.e., increased steerability with rotating cutting elements on the wall of a wellbore) because cutting elements on the outwardly facing cones can cut the borehole side wall directly. Further, outwardly facing roller cones on a hybrid bit of the present disclosure allows for a larger bottom hole coverage than that of conventional inward cone hybrid bits.

Figure 14A:
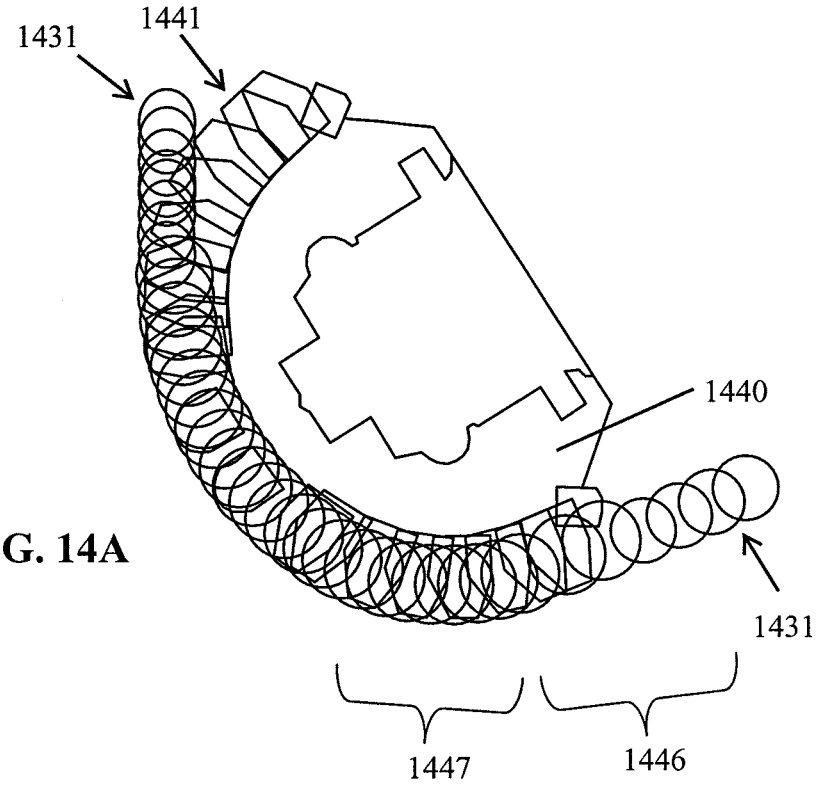
FIGS. 14A-D show a schematic perspective of part of a hybrid bit according to an embodiment of the present disclosure and a schematic perspective of part of a hybrid bit according to a prior art embodiment.
Figure 14B:
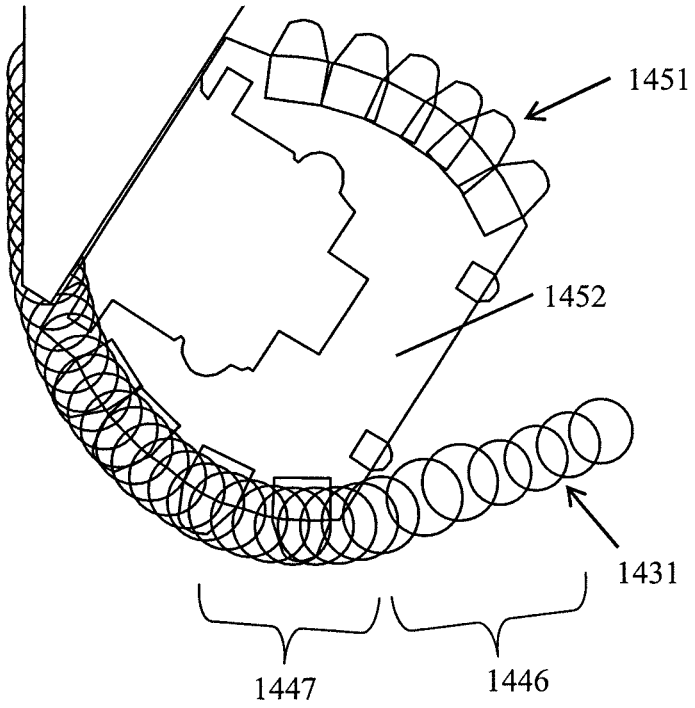
FIG. 14B (Prior Art)

Additionally, the outwardly facing roller cones allow for the roller cones to have a profile easily matching the cutting blades profile, which also helps to optimize bit performance. For example, a comparison between an exemplary embodiment of the present invention and a prior art embodiment is shown in FIGS. 14A-D. FIG. 14A shows the profile of a roller cone and blade, 1441 and 1431 respectively, according to an embodiment of the present invention, and FIG. 14B shows a roller drum profile 1451 (roller cone with a drum profile) and blade profile 1431 of a prior art hybrid bit, where the roller drum is mounted on a journal extending radially inward. Advantageously, an increased roller cone and blade profile match may be achieved by using an outwardly facing roller cone 1440, when compared to an inwardly facing roller drum 1452. Specifically, embodiments according to the present invention may have a roller cone profile 1441 that fully covers the nose region 1447 and substantially covers the cone region 1446, whereas the prior art embodiment has barely any coverage in the nose region 1447 and no coverage in the cone region 1446. Further, by adjusting the journal angle and cone shape, an outwardly facing roller cone may be made to match almost any blade cutting profile with a significantly greater overlap.

Figure 14C:
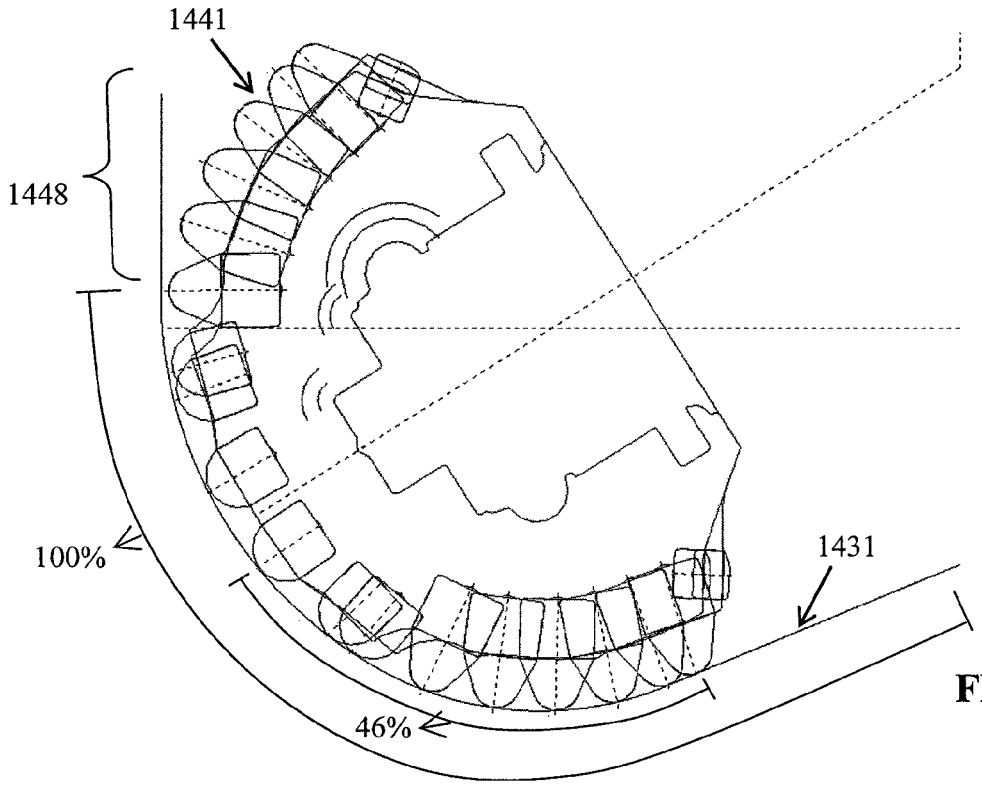
Figure 14D:
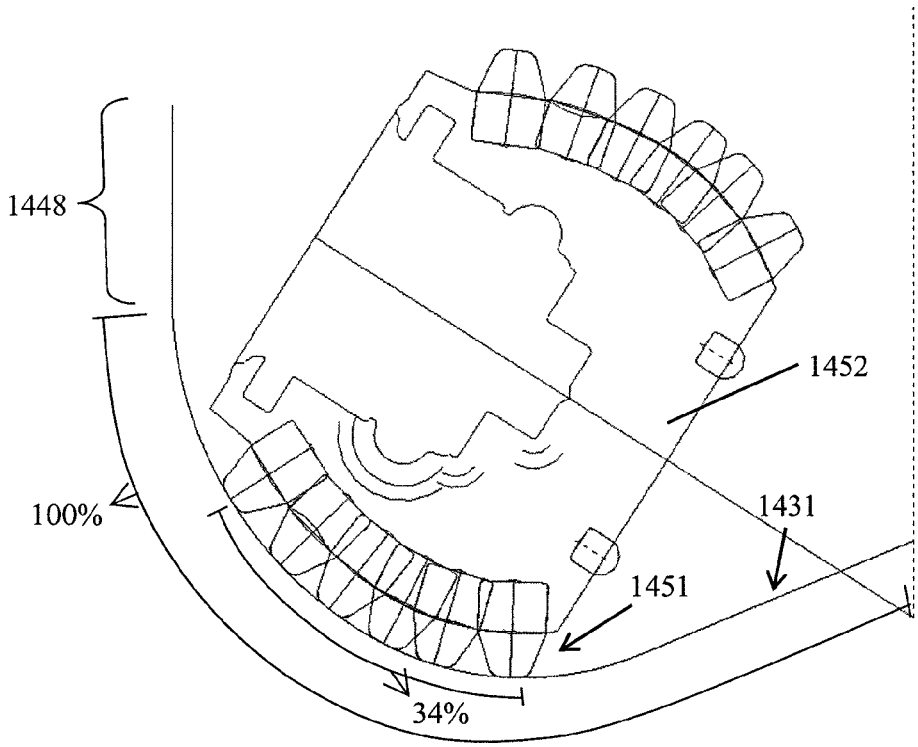
FIG. 14D (Prior Art)

FIGS. 14C and 14D show a comparison between the cutting profile overlap of an exemplary embodiment of the present disclosure and the cutting profile overlap of a prior art embodiment. Specifically, the cutting profile overlaps are measured in relation to all regions of the blade profile 1431, excluding the gage region 1448. As shown in FIG. 14C, the profile of an outwardly facing roller cone 1441 overlaps with about 46% of the blade profile 1431, including the nose region of the blade and some of the cone region of the blade. However, in an exemplary prior art embodiment, as shown in FIG. 14D, the cutting profile 1451 of an inwardly facing roller drum 1452 overlaps with only about 34% of the blade profile 1431. The embodiments shown in FIGS. 14A-D are merely examples of profile overlaps, which are used to show an advantage of using outwardly facing roller cone and blade hybrid bits according to embodiments of the present disclosure. In particular, using outwardly facing roller cone and blade hybrid bits according to embodiments of the present disclosure allows for a greater profile overlap with the blade(s) when compared to prior art embodiments.

Compared with conventional PDC bits, the hybrid bit of the present disclosure offers the following potential advantages. Hybrid bits of the present disclosure may provide higher cutting efficiency in the nose/shoulder areas by having compatible cutting mechanisms and greater overlap between the outwardly facing roller cones and blades. By increasing the efficiency of PDC cutter shearing action (near the nose/shoulder area) on outwardly facing cone hybrid bits of the present disclosure, gage cutting action is enhanced when compared to the gage cutting capabilities of conventional PDC bits. Hybrid bits of the present disclosure also provide better directional drilling abilities than conventional PDC bits.

Further, the combination of roller cone/disk and blade cutting actions allows for drilling a wider range of formations (e.g., mixed formations) while also allowing for higher rates of penetration as insert wear progresses. Thus, hybrid bits having outwardly facing roller cones may be less sensitive to formation changes than PDC bits. For example, conventional PDC bits can generate large axial and vertical vibration in hard and inhomogeneous formations.

Additionally, hybrid bits according to the present disclosure may offer the following advantages over conventional roller cone drill bits. In hybrid bits according to the present disclosure, bearing force can be small due to sharing force between other blades and roller cones. In particular, less torque is applied to the bit, so more weight on the bit ("WOB") can be applied in actual drilling. Blade cutting force may also be reduced since the total cone force is close to or more than half of the force applied from the WOB. Because hybrid bits having outwardly facing cones have blades to share the WOB with the roller cones, more WOB can be added to hybrid bits of the present disclosure than on conventional roller cone drill bits. Thus, an increased rate of penetration is possible with the hybrid bits of the present disclosure without causing damage to the bearing/journal systems.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body;

at least one blade extending radially from the bit body;

a plurality of blade cutting elements disposed on the at least one blade and forming a blade cutting profile extending through at least nose, shoulder, and gage regions;

at least one journal extending directly from the bit body and downwardly and radially outward from a longitudinal axis of the drill bit, wherein the at least one journal has a journal axis;

a rolling cutter mounted rotatably to each of the at least one journal, wherein the rolling cutter is a roller cone or a roller disk; and a plurality of cutting elements disposed on each rolling cutter and forming a rolling cutter cutting profile, wherein the rolling cone cutting profile overlaps with the blade cutting profile at least in the shoulder and nose regions of the blade cutting profile.

2. The drill bit of claim 1, wherein each rolling cutter is positioned between two pairs of the at least one blade.

3. The drill bit of claim 1, wherein the rolling cutter cutting profile overlaps with the blade cutting profile by at least 60%.

4. The drill bit of claim 1, wherein the rolling cutter cutting profile is offset a distance from the blade cutting profile, such that the plurality of rolling cutter cutting elements extend deeper into a working surface than the blade cutting elements.

5. The drill bit of claim 4, wherein the offset distance is between about 0.02 and about 0.08 inches.

6. The drill bit of claim 1, further comprising:

a ball race configured between the at least one journal and the rolling cutter;

a plurality of retention balls disposed within the ball race;

a ball passage extending from an outer face of the bit body to the ball race; and a ball retainer.

7. The drill bit of claim 6, wherein the ball passage has a ball passage center axis that intersects the journal axis such that the ball passage center axis forms an acute angle with the journal axis.

8. The drill bit of claim 7, wherein the acute angle is between 20 and 40 degrees.

9. The drill bit of claim 6, wherein the ball passage has a ball passage center axis that forms a β angle with a plane perpendicular to the journal, wherein the plane intersects the journal axis and the longitudinal axis of the bit body.

10. The drill bit of claim 6, wherein two or more ball passages extend from an outer face of the bit body to a ball race, wherein the two or more ball passages do not intersect.

11. The drill bit of claim 6, wherein the ball passage traverses through the bit body.

12. The drill bit of claim 1, wherein the blade cutting profile further comprises a cone region, wherein the rolling cutter cutting profile also overlaps with the blade cutting profile in the cone region of the blade cutting profile.

13. The drill bit of claim 1, wherein the rolling cutter cutting profile also overlaps with the blade cutting profile in the gage region of the blade cutting profile.

14. The drill bit of claim 1, further comprising a gage pad on the bit body above each rolling cutter.

15. A drill bit, comprising:
- a bit body;
- at least one blade extending radially from the bit body;
- a plurality of blade cutting elements disposed on the at least one blade;
- at least one journal extending downwardly and radially outward from a longitudinal axis of the drill bit, wherein the at least one journal comprises:
  - a first end having a bearing surface;
  - a second end insertable into a cavity in the bit body; and
  - a shaft between the first and second ends, wherein the shaft comprises a lube hole positioned between two grooves;
- a rolling cutter mounted rotatably to each of the at least one journal, wherein the rolling cutter is a roller cone or a roller disk;
- a ball race configured between the at least one journal and the rolling cutter;
- a plurality of retention balls disposed within the ball race;
- a ball passage extending from the ball race into the bit body;
- a ball retainer; and
- a plurality of cutting elements disposed on each rolling cutter.

16. The drill bit of claim 15, wherein the second end of two or more journals fit together such that the lube hole on each journal corresponds to a lubricant passage extending from a grease reservoir through the bit body.

17. The drill bit of claim 15, further comprising two seals positioned within the two grooves.

18. The drill bit of claim 15, wherein the ball passage has a ball passage center axis that intersects the journal axis such that the ball passage center axis forms an acute angle with the journal axis.

19. The drill bit of claim 15, wherein the bit body comprises tungsten carbide.

20. A drill bit, comprising
- a bit body, wherein the bit body comprises:
  - at least one blade extending radially from the bit body;
  - at least one journal attached to the bit body, wherein the at least one journal has a journal axis; and
  - wherein the bit body comprises at least 75% matrix material
  - wherein the at least one journal extends downwardly and radially outward from a longitudinal axis of the drill bit, and
  - wherein the at least one journal comprises:
    - a bearing end;
    - a journal locking end; and
    - a shaft extending between the bearing end and the journal locking end, wherein the shaft comprises a lube hole positioned between two grooves.

21. The drill bit of claim 20, wherein a roller cone is mounted rotatably to each of the at least one journal, and wherein a plurality of roller cone cutting elements are disposed on each roller cone and a plurality of blade cutting elements are disposed on each blade.

22. The drill bit of claim 20, wherein a roller disk is mounted rotatably to each of the at least one journal, and wherein a plurality of roller disk cutting elements are disposed on each roller cone and a plurality of blade cutting elements are disposed on each blade.

23. A method of manufacturing a hybrid drill bit, comprising:
- forming a bit body comprising a threaded pin end and a cutting end, wherein at least one blade is formed on the cutting end, and
- wherein a plurality of blade cutting elements disposed on the at least one blade and forming a blade cutting profile extending through at least nose, shoulder, and gage regions;
- machining at least one threaded connection in the cutting end of the bit body;
- threadedly attaching at least one journal to the threaded connection such that the at least one journal extends directly from the bit body and downward and radially outward from a longitudinal axis of the bit body; and
- mounting a rolling cutter to each of the at least one journal, wherein the rolling cutter is a roller cone or a roller disk, and
- wherein a plurality of cutting elements disposed on each rolling cutter and forming a rolling cuter cutting profile, and wherein the rolling cone cutting profile overlaps with the blade cutting profile at least in the shoulder and nose regions of the blade cutting profile.

* * * * *